US005113599A

United States Patent [19]

Cohen et al.

[11] Patent Number: 5,113,599

[45] Date of Patent: May 19, 1992

[54] ATHLETIC SHOE HAVING INFLATABLE BLADDER

[75] Inventors: Eric D. Cohen, Belmont; Andrew R. Jones, Roslindale; Jose T. de Castro, Brookline; Paul Litchfield, Worcester; Steven F. Smith, Taunton, all of Mass.

[73] Assignee: Reebok International Ltd., Stoughton, Mass.

[21] Appl. No.: 588,828

[22] Filed: Sep. 27, 1990

Related U.S. Application Data

[63] Continuation of Ser. No. 530,854, May 30, 1990, which is a continuation-in-part of Ser. No. 307,566, Feb. 8, 1989, abandoned, which is a continuation-in-part of Ser. No. 89,749, Aug. 27, 1987, abandoned.

[51] Int. Cl.[5] ..... A43B 7/06; A43B 7/14

[52] U.S. Cl. ..... 36/88; 36/114; 36/29; 36/71

[58] Field of Search ..... 36/28, 29, 3 B, 88, 36/89, 93, 114, 71, 117, 119, 86; 137/625.47

[56] References Cited

U.S. PATENT DOCUMENTS

| | | | |
|---|---|---|---|
| D. 246,486 | 11/1977 | Nickel . | |
| D. 302,764 | 8/1989 | Peoples et al. . | |
| D. 307,508 | 5/1990 | Miller et al. . | |
| D. 309,211 | 7/1990 | Nakagawa . | |
| 508,034 | 11/1889 | Moore . | |
| 510,504 | 12/1893 | Foster . | |
| 545,705 | 9/1895 | MacDonald . | |
| 547,645 | 10/1895 | Lacroix . | |
| 566,422 | 8/1896 | Singleton . | |
| 580,501 | 4/1897 | Mobberley . | |
| 586,155 | 7/1897 | Bascom . | |
| 692,170 | 1/1902 | Wallerstein et al. | 137/625.47 |
| 806,267 | 12/1905 | King . | |
| 850,327 | 4/1907 | Tauber . | |
| 900,867 | 10/1908 | Miller . | |
| 950,333 | 2/1910 | Koch . | |
| 1,059,485 | 4/1913 | Orlopp | 137/625.47 |
| 1,069,001 | 7/1913 | Guy . | |
| 1,145,534 | 7/1915 | Wetmore . | |
| 1,148,376 | 7/1915 | Gay . | |
| 1,184,013 | 5/1916 | Pierce . | |
| 1,193,608 | 8/1916 | Poulson . | |
| 1,216,795 | 2/1917 | Gause . | |
| 1,241,832 | 10/1917 | Druckenmiller . | |
| 1,285,695 | 11/1918 | Harman | 137/625.47 |

(List continued on next page.)

FOREIGN PATENT DOCUMENTS

| | | |
|---|---|---|
| 1143938 | 4/1983 | Canada . |
| 0040189 | 4/1981 | European Pat. Off. . |
| 0152401 | 8/1985 | European Pat. Off. . |
| 0184781 | 6/1986 | European Pat. Off. . |
| 867585 | 1/1953 | Fed. Rep. of Germany . |
| 917173 | 7/1954 | Fed. Rep. of Germany . |
| 2005365 | 9/1970 | Fed. Rep. of Germany . |
| 2308547 | 8/1974 | Fed. Rep. of Germany . |
| 2365329 | 9/1974 | Fed. Rep. of Germany . |
| 2456612 | 6/1975 | Fed. Rep. of Germany . |
| 2845824 | 5/1979 | Fed. Rep. of Germany . |
| 2800359 | 7/1979 | Fed. Rep. of Germany . |
| 3427644 | 1/1986 | Fed. Rep. of Germany . |
| 8802338.9 | 8/1989 | Fed. Rep. of Germany . |
| 720257 | 2/1932 | France . |
| 1204093 | 1/1960 | France . |
| 2026062 | 9/1970 | France . |
| 2356384 | 1/1978 | France . |
| 2496423 | 6/1982 | France . |
| WO87/03789 | 7/1987 | PCT Int'l Appl. . |
| 14955 | of 1894 | United Kingdom . |
| 26637 | of 1897 | United Kingdom . |
| 23547 | of 1900 | United Kingdom . |
| 520514 | 4/1940 | United Kingdom . |
| 817521 | 7/1959 | United Kingdom . |

*Primary Examiner*—Steven N. Meyers

*Attorney, Agent, or Firm*—Sterne, Kessler, Goldstein & Fox

[57] ABSTRACT

An athletic shoe is described, provided with an inflatable tongue or bladder for a more secure fit to the user's foot. The bladder may include a plurality of chambers with a valve disposed therebetween to selectively inflate the chambers. The inflatable tongue or bladder has a lightweight pump disposed thereon.

14 Claims, 19 Drawing Sheets

U.S PATENT DOCUMENTS

| | | | |
|---|---|---|---|
| 1,304,915 | 5/1919 | Spinney . | |
| 1,498,838 | 6/1924 | Harrison, Jr. . | |
| 1,605,985 | 11/1926 | Rasmussen . | |
| 1,954,122 | 4/1934 | Fiori . | |
| 1,979,972 | 11/1934 | Guild . | |
| 2,007,803 | 7/1935 | Kelly . | |
| 2,020,240 | 11/1935 | Cochran . | |
| 2,074,286 | 3/1937 | Sullivan . | |
| 2,080,469 | 5/1937 | Gilbert . | |
| 2,080,499 | 5/1937 | Nathansohn . | |
| 2,177,116 | 10/1939 | Persichino . | |
| 2,488,382 | 11/1949 | Davis . | |
| 2,532,742 | 12/1950 | Stoiner . | |
| 2,600,239 | 6/1952 | Gilbert . | |
| 2,605,560 | 8/1952 | Gouabault . | |
| 2,638,690 | 5/1953 | Bullard, III . | |
| 2,677,904 | 5/1954 | Reed . | |
| 2,677,906 | 5/1954 | Reed . | |
| 2,762,134 | 9/1956 | Town . | |
| 3,027,659 | 4/1962 | Gianola . | |
| 3,044,190 | 7/1962 | Urbany . | |
| 3,120,712 | 2/1964 | Menken . | |
| 3,180,039 | 4/1965 | Burns, Jr. . | |
| 3,225,463 | 12/1965 | Burnham . | |
| 3,273,263 | 9/1966 | Klima . | |
| 3,410,004 | 11/1968 | Finn . | |
| 3,685,176 | 8/1972 | Rudy . | |
| 3,716,930 | 2/1973 | Brahm . | |
| 3,721,265 | 3/1973 | Hoffland | 137/625.47 |
| 3,738,024 | 6/1973 | Matsuda . | |
| 3,744,159 | 7/1973 | Nishimura . | |
| 3,765,422 | 10/1973 | Smith . | |
| 3,795,994 | 3/1974 | Ava . | |
| 3,888,242 | 6/1975 | Harris et al. . | |
| 3,973,336 | 8/1976 | Ahn . | |
| 4,123,855 | 11/1978 | Thedford . | |
| 4,178,013 | 12/1979 | Bataille . | |
| 4,183,156 | 1/1980 | Rudy . | |
| 4,211,236 | 7/1980 | Krinsky . | |
| 4,217,705 | 8/1980 | Donzis . | |
| 4,232,459 | 11/1980 | Vaccari . | |
| 4,236,725 | 12/1980 | Bataille . | |
| 4,372,297 | 2/1983 | Perlin . | |
| 4,397,104 | 8/1983 | Doak . | |
| 4,417,407 | 11/1983 | Fukuoka . | |
| 4,446,634 | 5/1984 | Johnson et al. . | |
| 4,458,429 | 7/1984 | Schmid . | |
| 4,462,171 | 7/1984 | Whispell . | |
| 4,571,853 | 2/1986 | Medrano . | |
| 4,583,305 | 4/1986 | Miyamoto . | |
| 4,610,099 | 9/1986 | Signori . | |
| 4,628,945 | 12/1986 | Johnson, Jr. . | |
| 4,631,843 | 12/1986 | Annovi . | |
| 4,654,986 | 4/1987 | George . | |
| 4,662,087 | 5/1987 | Beuch . | |
| 4,670,995 | 6/1987 | Huang . | |
| 4,702,022 | 10/1987 | Porcher . | |
| 4,712,316 | 12/1987 | Baggio . | |
| 4,730,403 | 3/1988 | Walkhoff . | |
| 4,763,426 | 8/1988 | Polus et al. . | |
| 4,779,359 | 10/1988 | Famolare, Jr. . | |
| 4,805,601 | 2/1989 | Eischen, Sr. . | |
| 4,823,482 | 4/1989 | Lakic . | |
| 4,852,274 | 8/1989 | Wilson . | |
| 4,856,208 | 8/1989 | Zaccaro . | |
| 4,906,502 | 3/1990 | Rudy . | |
| 4,912,861 | 4/1990 | Huang . | |
| 4,995,173 | 2/1991 | Spier | 36/29 |
| 4,999,932 | 3/1991 | Grim | 36/29 |

ATHLETIC SHOE HAVING INFLATABLE BLADDER

This application is a continuation of U.S. Pat. application Ser. No. 07/503,854, filed May 30, 1990, which in turn is a continuation-in-part of U.S. Pat. application Ser. No. 307,566, filed Feb. 8, 1989, now abandoned, which in turn is a continuation-in-part of U.S. Pat. application Ser. No. 89,749, filed Aug. 27, 1987, now abandoned.

FIELD OF THE INVENTION

This invention relates to improved athletic shoes of the type having flexible uppers and, more particularly, to athletic hoses suitable for exercise activities, for example, for basketball, aerobics, tennis or for activities such as running.

BACKGROUND OF THE INVENTION it is known that athletic footwear must perform as a stable and comfortable support point for the body while subject to various types of stress. It is important that the shoe be comfortable and provide adequate support during the various foot movements associated with athletic activity.

Articles of footwear typically include an upper and a sole, and are sold in a variety of sizes according to the length and width of the foot. However, even feet of similar length do not necessarily have the same geometry. Therefore, the upper may be adjustable to accommodate various foot contours. Such adjustment may include medial and lateral side portions which, when tensioned, provide support to the foot. In addition, the upper may include an ankle portion which encompasses a portion of the ankle region of the foot and thereby provides support thereto.

The common way to adjust the size of a shoe is through lacing. Lacing alone, however, suffers from several disadvantages, for example, when the shoe laces or strap is drawn too tightly, the fastening system can cause pressure on the instep of the foot. Such localized pressure is uncomfortable to the wearer and can make it difficult for the shoe to be worn for prolonged periods of time. Furthermore, while such fastening systems allow the upper of the shoe to be adjustable to accommodate varying foot and ankle configurations, they do not necessarily mold to the contour of individual feet. Moreover, regardless of how much tension is exerted on the medial and lateral side portion, there still remain areas of the foot which are not supported by the upper, due to the irregular contour of the foot. Avoiding displacements between the footwear and the foot results in less strain on the ankle and other parts of the foot.

In the ski industry, there have been several attempts to provide cushioning to ski boots by using an inflatable bladder which is disposed in various locations within the ski boot. An example is found in U.S. Pat. No. 4,662,087 to Beuch. However, the technical considerations for providing cushioning to athletic shoes such as those used for basketball, tennis, aerobics and running do not parallel the technical considerations in the ski boot industry. Athletic shoes for sports such as basketball, tennis, aerobics and running have soft, flexible uppers which are stitched (not hard molded plastic as in ski boots). Additionally, athletic shoes must be relatively lightweight, inexpensive, and self-contained.

Ski boots are typically constructed to be much heavier than athletic shoes. Thus, when including a system for cushioning, such as a bladder system, the weight of the system is not a technical consideration.

Similarly, ski boots are a much more expensive consumer item than athletic shoes. Therefore, the same incremental cost of an inflatable bladder system used in ski boots cannot realistically be added to athletic shoes. Any cushioning system added to athletic shoes must be inexpensive and simple to use.

In this regard, it is imperative that athletic shoes be self-contained so that accessories, such as a detachable handheld pump, are not necessary to the operation of the cushioning system.

In short, there are numerous devices for inflating the interior of the ski boot. Generally, the devices used in the field of ski boots do not have the same requirements as in the field of athletic footwear. It is extremely important in the field of athletic footwear (e.g., basketball, running, tennis, etc.) that any inflation cushioning device be lightweight, inexpensive and must include a pump which is integral with the shoe. Ski boots are heavy. Therefore, adding the weight of an inflation or support device is of little consequence. In athletic footwear, every ounce of weight is of great importance in the performance and comfort of the shoe.

It is an object of this invention to provide footwear, which is securely fitted and fastened to the foot of the wearer, whereby a comfortable but secure grip is assured around the ankle and around the instep of the wearer.

It is a further object of this invention to provide a bladder in an athletic shoe which is lightweight, inexpensive, self-contained, and easy to use.

SUMMARY OF THE INVENTION

In accordance with the purposes of the present invention as embodied and described herein, the present invention is an athletic shoe having an inflatable bladder which fits the anatomical shape of a foot and avoids gaps or empty regions between the upper and the foot.

The present invention is an athletic shoe having an upper made of a flexible material. A bladder is disposed within the flexible upper and is in communication with a pump which is attached to the upper, and forms a cavity. The pump may be conveniently located at the top of the tongue of the athletic shoe or on the side of the athletic shoe.

In one aspect of the invention, the bladder has a lateral side portion, a medial side portion, and an instep portion. The bladder may also include a release valve which may be disposed in close proximity to the pump.

In one aspect of the invention, the pump and a portion of the release valve are formed from a single molded piece of material which is welded to the bladder.

One advantage provided by the invention is the compensation of the inequalities or bumps due to the interlacement of the laces in the buckling zone. Another advantage of the invention is that a shoe is provided with helps push the heel of a wearer back in the shoe, toward a heel counter.

In addition, the present invention is extremely lightweight and simple. The invention allows a lightweight pump to be made integral with an athletic shoe, eliminating the need for a separate accessory (i.e., the pump) to be sold with the shoe.

In one aspect of the invention, a rubber bulb pump is formed on the top of the tongue of the athletic shoe or on the side of the shoe for convenient access.

BRIEF DESCRIPTION OF THE DRAWINGS

The accompanying drawings, which are incorporated in and form a part of the specification, illustrate the embodiments of the present invention and together with the description serve to explain the principles of the invention. In the drawings.

DETAILED DESCRIPTION OF THE PREFERRED EMBODIMENT OF THE INVENTION

Reference will be made in detail below to the preferred embodiments of the invention, examples of which are illustrated in the accompanying drawings in most instances. Similar or identical structure is identified using identical numbers.

Figure 1:
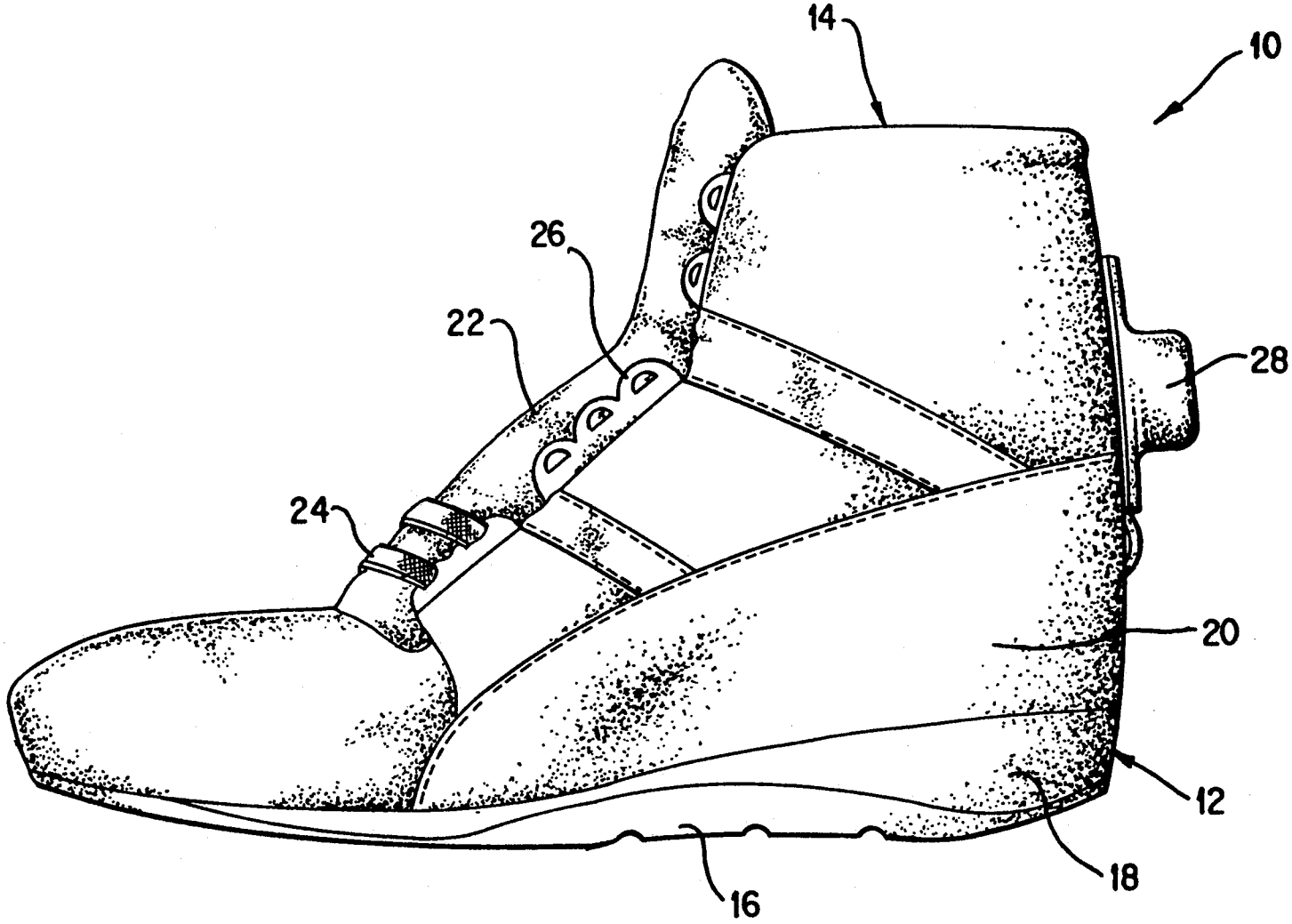
FIG. 1 is a left side view of footwear incorporating one embodiment of the invention.

Referring now to the embodiment of the invention shown in FIG. 1, a shoe is shown generally at 10. Shoe 10 incorporates the support system of the present invention. The support system, which will be discussed in detail below, allows a wearer to select the desired pressure applied to the foot of the wearer.

A variety of shoe structures are capable of incorporating the present invention. However, it is preferred that shoe 10 include a sole, shown generally at 12, and an upper, shown generally at 14. The sole 12 generally includes a ground engaging outsole 16 which is made of an abrasive resistant material as is conventional and generally found in athletic shoes (such as basketball shoes, tennis shoes, aerobic shoes, running shoes, etc.). Disposed between outsole 16 and upper 14 is a midsole 18 which is typically made out of ethyl vinyl acetate (EVA) or polyurethane (P.U.). Although foam EVA and P.U. midsoles are well-known, there are other possible midsole configurations and structures that could be used in conjunction with the present invention. For example, it is possible to use the present invention in conjunction with pneumatic midsoles or midsoles having support structures which are made of materials such as HYTREL, a material available from E.I. DuPont de Nemours and Co. An example of such a support structure is sold by Reebok under the trademark ENERGY RETURN SYSTEM (ERS). This technology utilizes a plurality of HYTREL tubes which are encapsulated within the midsole of an athletic shoes. These tubes extend substantially perpendicular to the longitudinal axis of the shoe and help the midsole material return quickly to its original shape.

Foam materials other than EVA or P.U. may also form the midsole used in the present invention. The upper may be made from a generally flexible material such as leather or other material as is generally known in the art of athletic footwear. Upper 14 may be attached to sole 12 by any known methods.

FIG. 1 shows a shoe for the left foot. A shoe incorporating the principles of the present invention for the right foot would be substantially a mirror image of FIG. 1. Shoe 10 may include a heel stabilizer 20, a tongue 22, laces 24 and eyestays 26. Naturally, many modifications can be made to the upper 14 without affecting the operation of the invention.

The present invention is a unique device for providing support to the foot of a wearer. The invention is used in athletic shoes such as those with midsoles and flexible uppers. In addition, the shoe provides for a custom fit. To provide support, a lightweight system which includes a bladder and pump is incorporated into an athletic shoe which enables a user to inflate a bladder to a desired pressure with a conveniently placed pump. The bladder, when inflated, helps push the heel of a wearer toward the back of the shoe, into a heel counter. In addition, the bladder is specially configured to assure that air is only distributed to those areas of the foot needing cushioning; it is lightweight so as to not significantly affect the ability of an athlete to move and it provides support to improve fit and reduce injuries.

Figure 2:
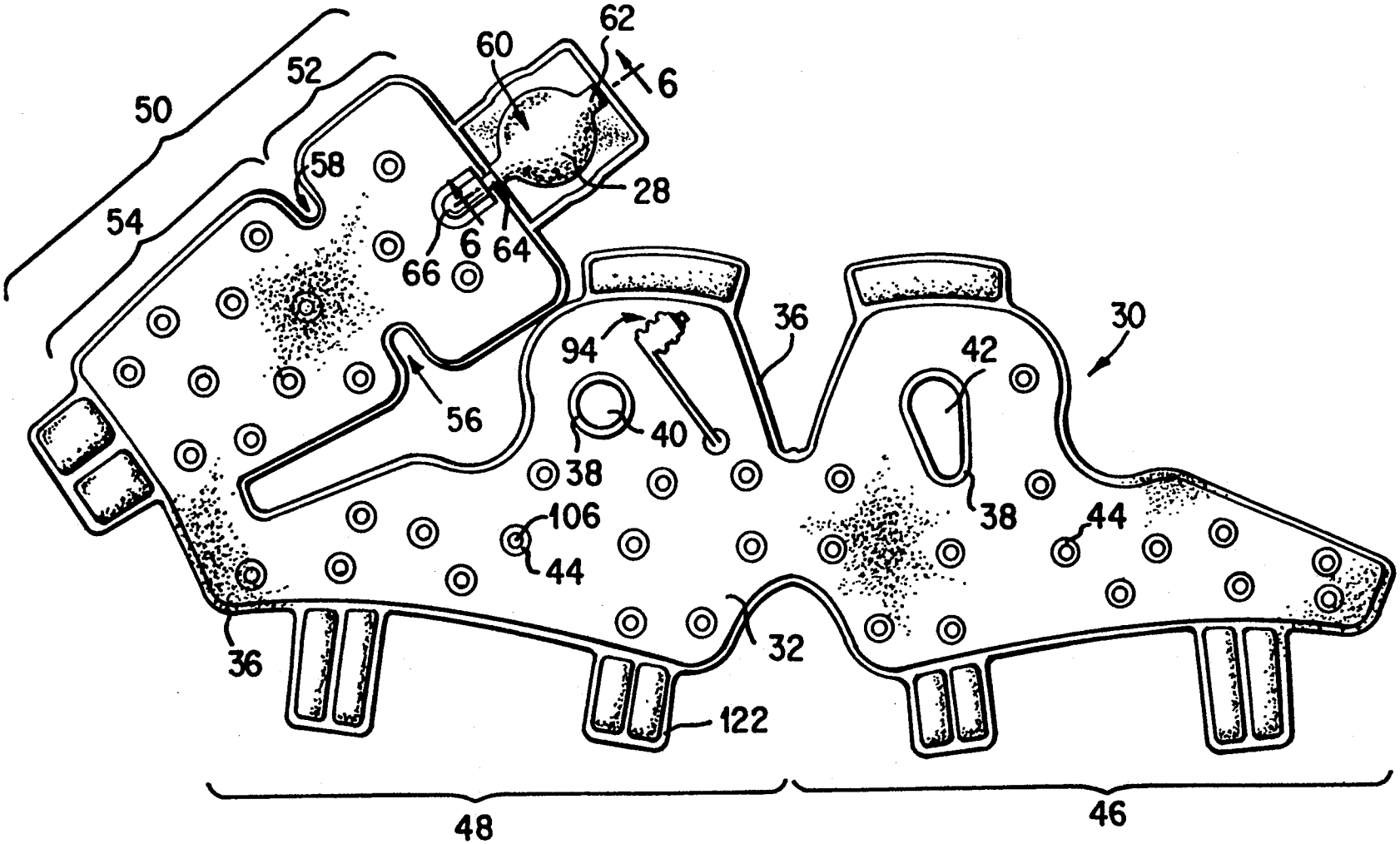
FIG. 2 is one embodiment of a bladder of the present invention.
Figure 3:
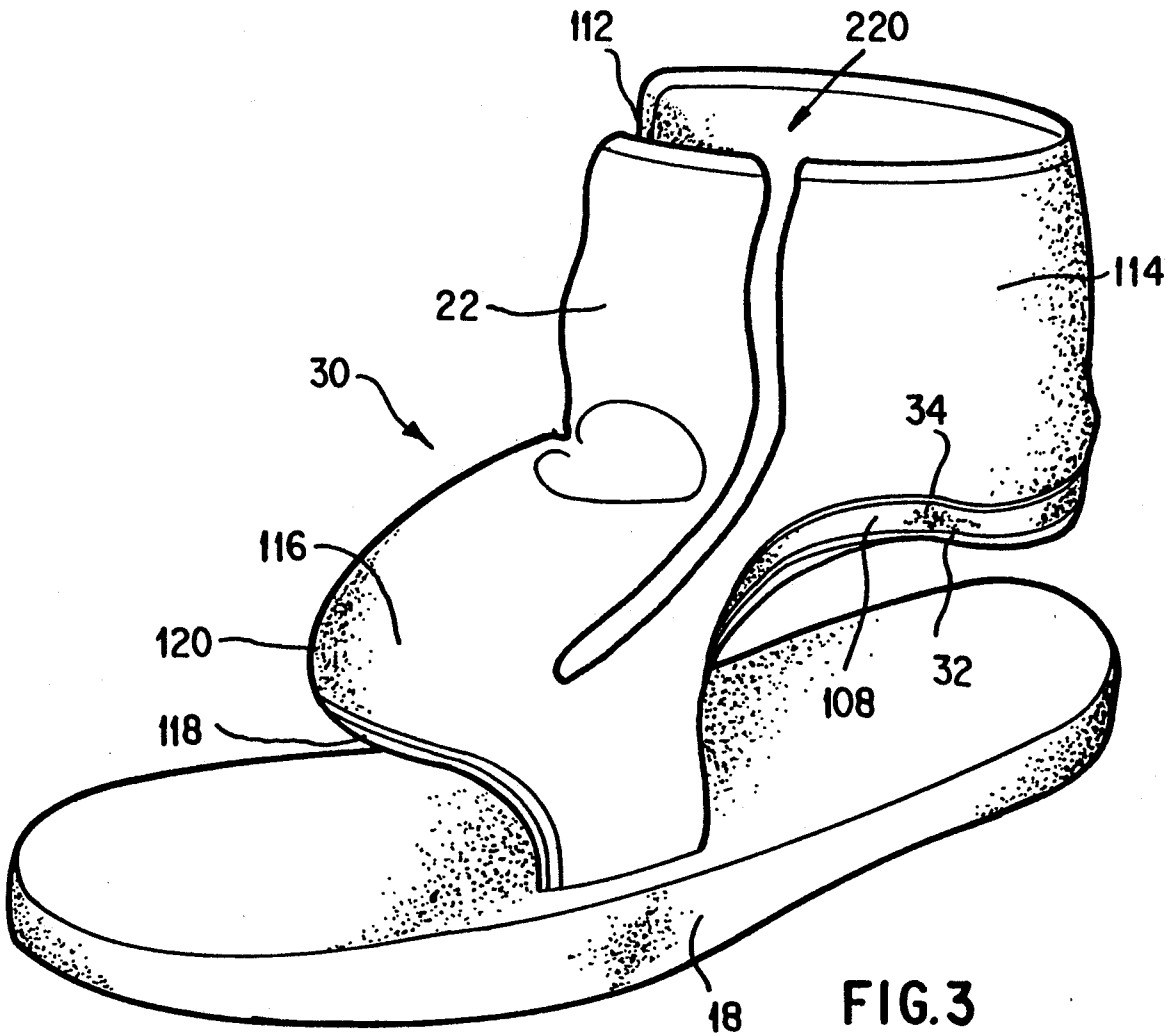
FIG. 3 is a perspective view of one embodiment of a bladder of the present invention.
Figure 4:
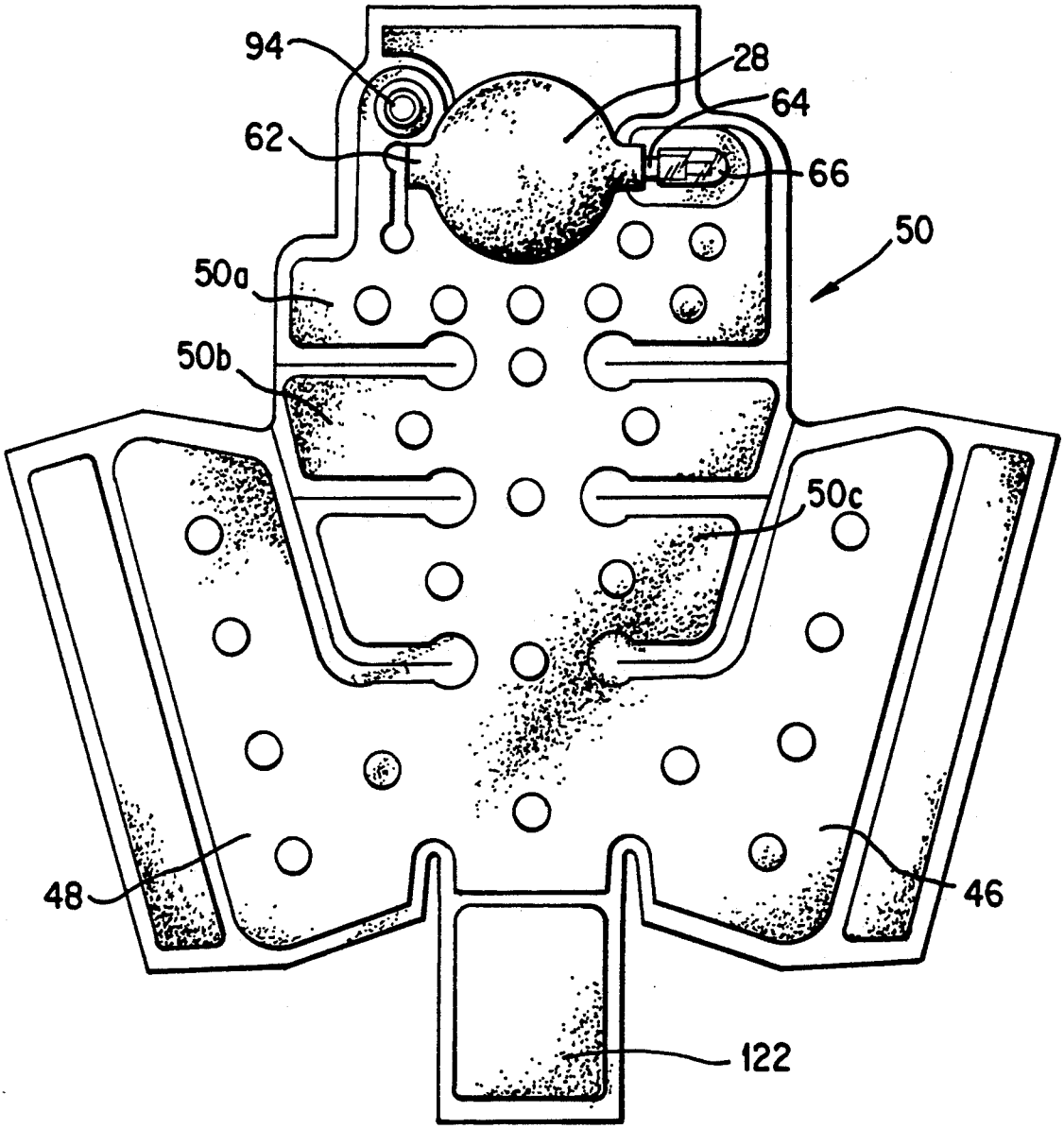
FIG. 4 is an alternative bladder of the present invention.

Referring now to FIGS. 2–4, three possible support systems of the present invention are shown. These systems include a pump 28 which is in fluid communication with inflatable bladder 30. Each component of the preferred elements of the support system as well as variations will be described individually below.

A. The Bladder

The bladder 30 is made of a number of component parts which include a first film or exterior layer 32 which is shaped as shown in FIG. 2. The exterior layer may be made of a lightweight urethane film such as is available from J. P. Stevens & Co., Inc., Northampton, Mass. as product designation MP1880. A second film or interior layer 34 (shown in FIG. 3) which is substantially co-extensive with exterior layer 32 is attached to the exterior layer 32 along periphery weld lines 36. The periphery weld lines 36 attach the exterior layer 32 to the interior layer 34 and prevent air from leaking therebetween. One example of a suitable method of attachment of the exterior layer 32 to the interior layer 34 is the application of high radio frequency (r.f.) to the edges of the first and second film. Interior weld lines 38 are also provided. These interior welded lines 38 are also formed by r.f. welding and define openings 40 and 42. In the embodiment of the invention shown in FIG. 2, a substantially circular opening 40 is used to accommodate the medial malleolus and an oblong opening 42 is used to accommodate the lateral malleolus. The shape of these openings is not critical to the practice of the invention. The interior layer 34 and the exterior layer 32 are attached at the periphery weld lines 36 as well as at the interior weld lines 38 and at the circular welds 44. The exterior layer 32 and interior layer 34 are otherwise not attached and enable a pocket or bladder to be formed which allows air or other gas to be introduced between the exterior layer 32 and the interior layer 34.

In addition, circular welds 44 are positioned throughout the bladder 30. These circular welds 44 are used to control the thickness of the bladder 30 when the bladder 30 is in its filled configuration (e.g., air has been pumped into the bladder 30). In regions of the bladder 30 where it is desirable to have the bladder inflated to a minimal thickness, the density of the circular welds 44 is greater than the areas where it is permissible or desirable for the bladder 30 to be inflated to a greater thickness. For example, it may be desirable to have the tongue inflate to a thickness which is less than the thickness around the ankles of the wearer. Conventional athletic shoes do not conform perfectly to the feet of the wearer. Such physiological variants as the size and shape of the ankle make it impossible to make a leather or canvas upper conform to the shape of the foot. It is, however, known where the largest spaces between the shoe and the foot are located. Thus, the circular weld density can be configured to have additional thickness in those areas.

Because the films forming the bladder walls are in contact at the circular welds 44, the thickness of the inflated bladder is reduced if there is a high density of circular welds 44. Conversely, if the circular welds 44 are far apart, that area between the circular welds 44 is allowed to expand to a greater thickness.

Figure 27:
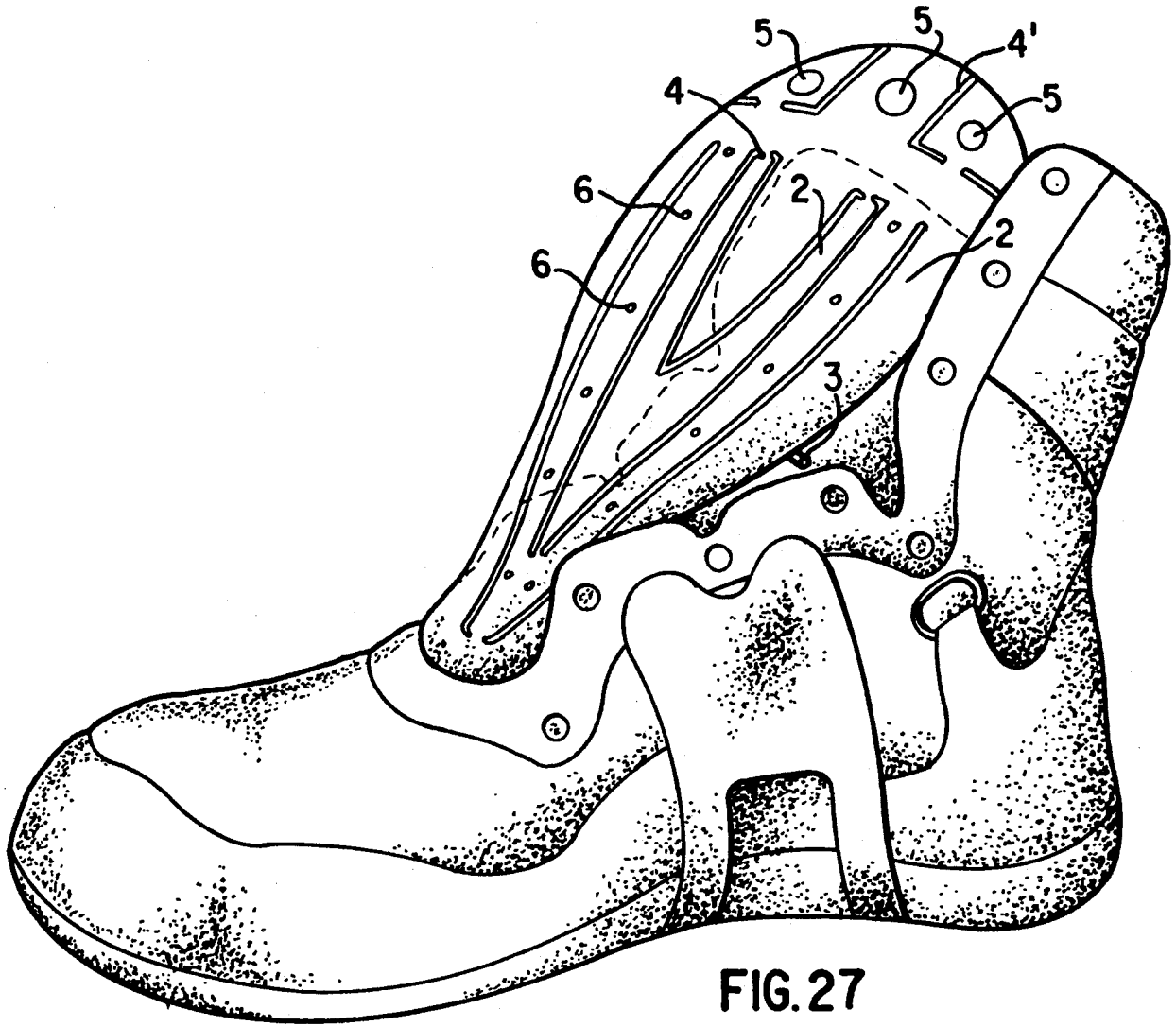
FIG. 27 is a perspective view of one embodiment of the present invention.
Figure 28:
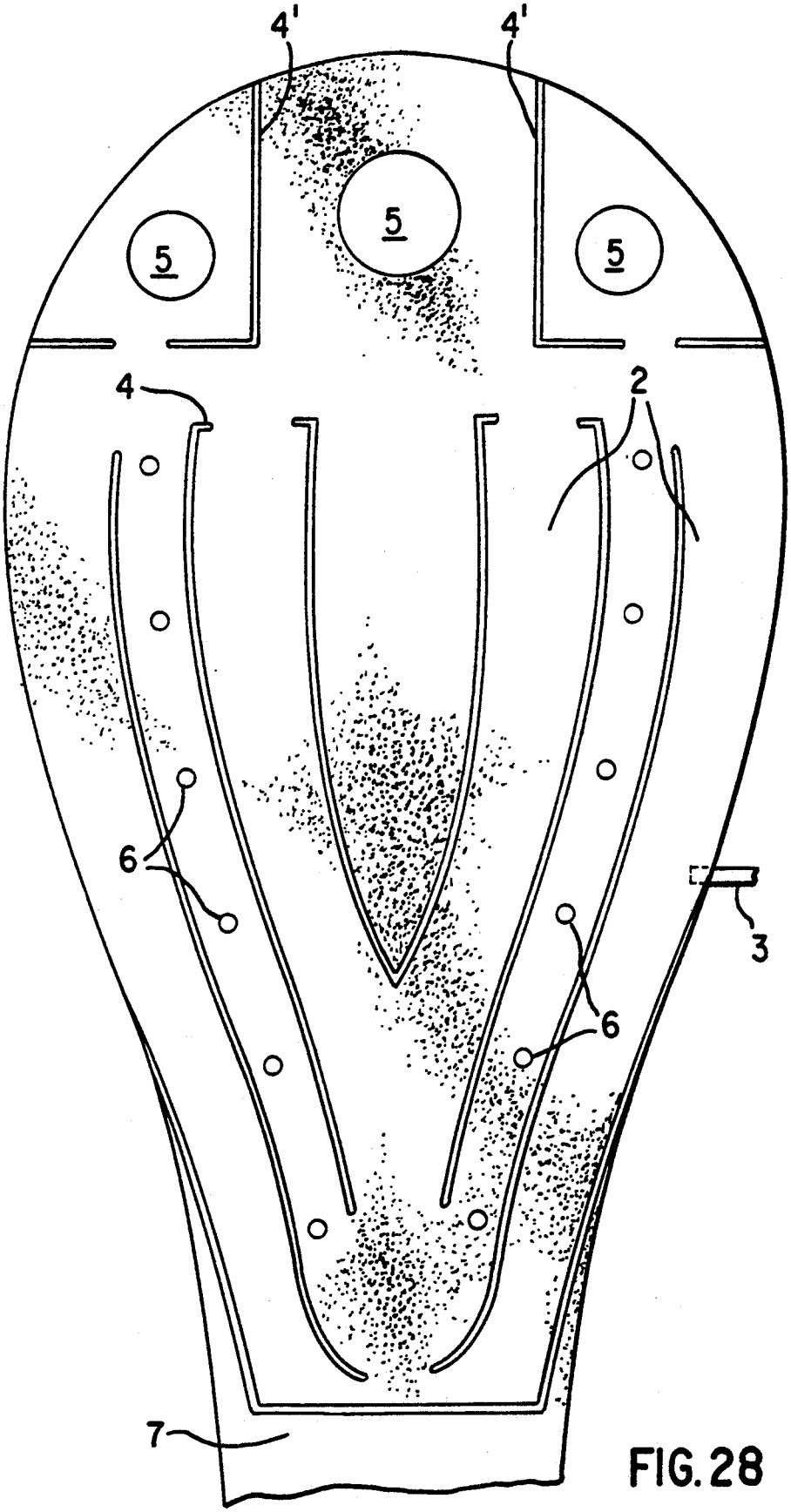
FIG. 28 is a top view of a tongue incorporating the present invention.

In addition to the use of circular welds to control the thickness of bladder 30 at particular locations, it is also possible to control the thickness of the bladder by the use of weld lines 4 and 4' (shown in FIGS. 27 and 28). In the embodiment of the invention shown in FIGS. 27 and 28, the bladder 30 is compartmented; individual compartments or fluid receiving chambers could be provided in various areas of bladder 30. One example would be to heat-seal seams along bladder 30. Such seams could also be perforated to allow ventilation to the foot. Such compartments may be interconnected or may be individually inflated by pump 28 or by several pumps.

The bladder shown in FIG. 2 has a number of different compartments which includes a lateral compartment 46, a medial compartment 48 and a tongue compartment 50. In the embodiment of the invention shown in FIG. 2, the density of circular welds 44 in the tongue region is high. Generally, it is not desirable for the tongue to obtain a thickness which is as great as the thickness in the lateral and medial compartments. By placing the circular welds 44 in selected locations, a contouring effect takes place whereby the regions having a low density of circular welds 44 will obtain thicknesses which are greater than the thicknesses of the high density regions.

In addition to the lateral compartment 46, the medial compartment 48, and the tongue compartment 50, each of these compartments may be further comparmentalized. For example, a first tongue section 52 and a second tongue section 54 may be placed in tongue compartment 50. The first section 52 and the second section 54 are separated by a pair of notches 56 and 58, one on each side of tongue compartment 50. These notches enable the tongue compartment 50 to easily flex at a location between the first section 52 and the second section 54.

The embodiment of the invention shown in FIG. 2 enables small aeration holes 106 to be placed in the circular welds 44. Because the welds 44 are circular and do not enable air to pass therethrough, the holes 106 can be placed within the welds 44 without risk of leakage of gas or air.

At one end of the tongue compartment 50 is a pump 28. The details of the pump shown in FIG. 2 and other pump configurations are discussed further below. In general, however, the pump shown in FIG. 2 is made of a hemispherical molded latex rubber located at the top of the tongue. Thus, when the bladder 30 is positioned in an athletic shoe, the pump 28 is conveniently located so that the wearer can simply place one finger, i.e., the thumb, on the rounded side of the molded rubber pump and another finger on the inside of the tongue, against the flat side of the pump. The pump can then be depressed to enable the bladder to be filled with air.

In the embodiment of the invention shown in FIG. 1, the pump is located in the back of the shoe. Alternatively, the pump can be placed on the tongue (as previously mentioned) or on either side of the shoe.

Figure 5:
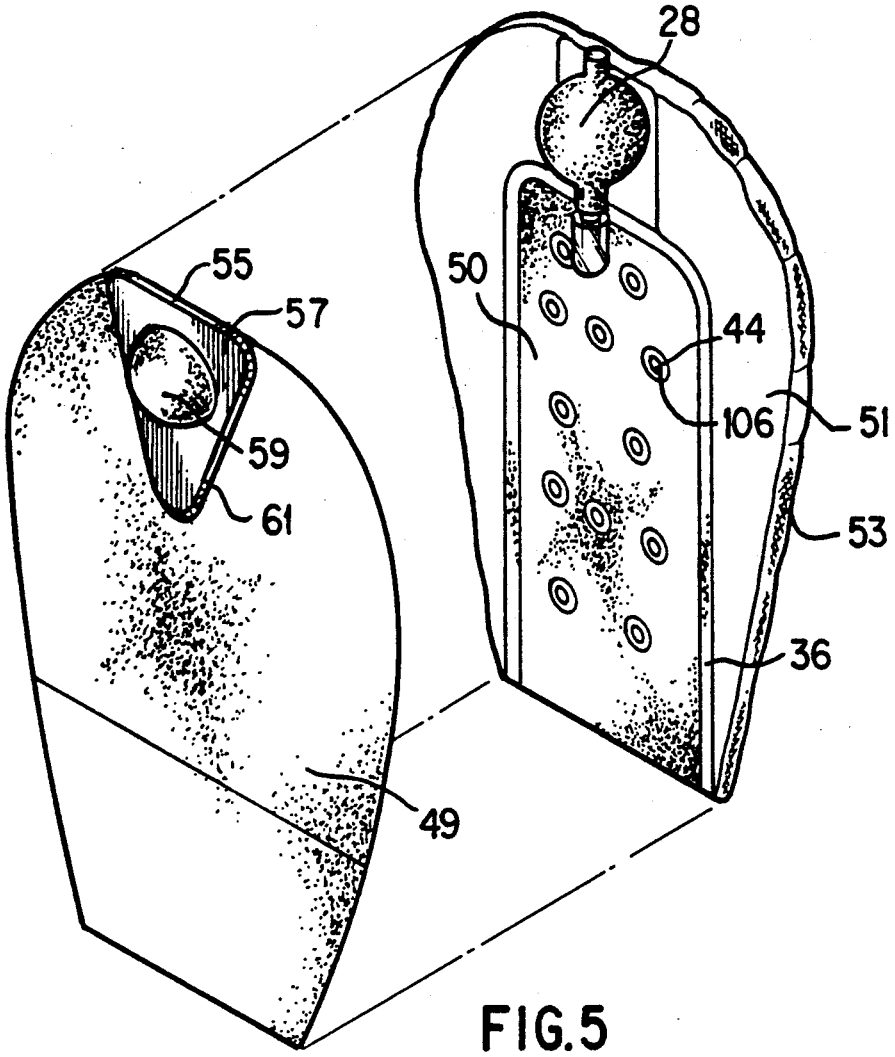
FIG. 5 is an exploded view of a tongue of one embodiment of the invention.

When the bladder shown in FIG. 2 is positioned within an upper of a shoe, the tongue compartment 50 lies between the outer material, e.g., leather or woven material, which would typically be seen in use and a layer of material such as flocking material. Referring to FIG. 5, an exploded view of a tongue used in the present invention is shown. The outer tongue material 49 is made of a conventional material such as leather or woven material or a combination thereof. The outer tongue material 49 is stitched to a tongue backing 51 which may include padding 53 and a cloth lining which makes contact with the foot of the wearer. The padding 53 may be made of any suitable padding material such as a soft foam which is conventionally utilized in the tongue of athletic footwear. Disposed between the outer tongue material 49 and the tongue backing 51 is one embodiment of a tongue compartment 50.

With continued reference to FIG. 5, a pump covering 55 is depicted. In a preferred embodiment of the invention, the pump covering 55 is made of a molded rubber material which has a substantially flat region 57, a bulb cover region 59, and a flange 61. The flange 61 enables the pump covering to be stitched to the outer tongue material. The bulb cover region 59 is generally hemispherically shaped and lies over the bulb shaped pump 28.

In operation of the bladder shown in FIG. 2, the tongue compartment 50 is placed within an upper of an athletic shoe between an outermost layer of material such as leather and an inner layer of material such as a lining within the shoe. Thus the bladder is not seen while in operation. The medial compartment 48 forms the medial portion of the shoe and again is disposed within the outer most layer or upper of the athletic shoe and an inner layer of material. The lateral compartment 46 then wraps around the heel and forms the lateral side of the athletic shoe. Again, this compartment is generally disposed between the flexible upper of the athletic shoe and an inner layer. The configuration of the bladder enables a single pump to inflate the entire upper of the athletic shoe. By providing the circular welds 44 in a particular orientation, for example that shown in FIG. 2, specific regions of the foot can receive more air than other regions.

A release valve 94 is disposed in the bladder 30 to enable air to be released. The details of the preferred release valve are discussed further below.

The bladder of the present invention may also have a number of other configurations. Referring to FIG. 4, a bladder 30 is shown for use in a low top athletic shoe such as a tennis, aerobics or running shoe. In this embodiment, the bladder has a tongue compartment 50. The tongue compartment 50 is segmented into three sections 50(*a*), 50(*b*) and 50(*c*). The tongue compartment is in fluid communication with a lateral compartment 46 and a medial compartment 48.

As with other embodiments of the invention, there are periphery weld lines 36 which connect two thin sheets of material such as lightweight polyurethane film. The sheets are welded together along weld lines 36 either by r.f. welding, heat welding, or by other suitable means, and then die cut to form the predetermined shape. The bladder 30 may include centering tabs 122 which are not filled with air but which are designed to help center or position the bladder 30 during the manufacturing process.

In operation of this embodiment (FIG. 4), the medial compartment 48 and the lateral compartment 46 are bent substantially perpendicular to the orientation they are shown in FIG. 4. As with other embodiments, a pump 28 is used to introduce air into the bladder 30. A release valve 92 may be used to release air from the bladder 30 according to the desires of the wearer.

The bladder of the present invention may also utilize a foam layer 108 (seen in FIG. 3) disposed between interior layer 34 and exterior layer 32. As previously stated, both exterior layer 32 and interior layer 34 are comprised of a suitable material, for example, a urethane film. Foam layer 108 may be comprised of any suitable resilient material capable of allowing fluid to pass therethrough. One example is an open-cell foam such as polyurethane open-cell or reticulated foam having 10 to 55 PPI (pores per inch). Such material is available from United Foam Plastics of Georgetown, Mass.

Exterior layer 32 and interior layer 34 with foam layer 108 disposed therebetween are attached at their edges to form bladder 30. Such attachment may be by any know methods, for example, by high radio frequency which welds the layers together, as described above. Alternatively, bladder 30 may form a part of upper 14 such that exterior layer 34 forms the interior of upper 14. Exterior layer 34 may have a brushed or napped surface facing the foot for improved comfort and may form the interior of the upper. Alternatively, a foot compatible liner may be affixed to the foot contacting surface of exterior layer 34.

Bladder 30 may include a foot opening 220, through which the foot of a wearer is inserted. Bladder 30 also includes a medial side portion 112, a lateral side portion 114, an instep portion 116, which underlies the tongue 22 of shoe 10, and a forefoot portion 118. Forefoot portion 118 connects medial side portion 112 and lateral side portion 114 with instep portion 116. Forward end 120 of bladder 30 terminates at a point short of the toe receiving end of sole 12. Alternatively, forward end 120 could extend the full length of sole 12, thereby covering the toes of a wearer, or forward end 120 could also be positioned at any point between the toe and heel receiving ends of sole 12.

Furthermore, while bladder 30 is shown to terminate where it joins sole 12, bladder 30 could extend along the top surface of sole 12, thereby underlying the foot of a wearer. One example of such a configuration would be to extend bladder 30 under the instep region of the foot to provide support and cushioning to the plantar arch.

The air pressure within bladder 30 affords support to the foot of a wearer otherwise unavailable from upper 14 alone. Furthermore, bladder 30 provides increased cushioning to the foot by molding to the particular contour of the foot and thereby, accommodating for anatomical irregularities inherent in the human foot. Therefore, bladder 30 allows the wearer individualized interior sizing of shoe 10.

Additionally, bladder 30 prevents uncomfortable localized pressure from the fastening system of the shoe by providing a cushion between the foot and the fastening system. Bladder 30 provides uniform cushioning by which pressure from the fastening system is distributed across bladder 30.

As shown in FIGS. 27 and 28, an athletic shoe is shown which is provided with a double wall tongue 1, within which there are arranged bags 2 which can be inflated through a small side tube 3 which is in turn provided with a valve for inflating, through a suitable tool. As it is best seen in FIG. 2, inflatable bags 2 may be all mutually connected, whereby pressure is uniformly distributed according to the shape of weld lines 4. Inflatable bags 2 have a slightly curved outline which diverges from the tongue base to the tongue tip, i.e., following the shape of said tongue, while at the free end of tongue 1 weld lines 4"are arranged at right angles in such a way as to define three bags, mutually connected as well, wherein the two lateral side ones are in the shape of quadrants of a circle. In order to avoid that the latter end inflatable bags, after inflating, take an excessively cushion-like shape, due to the position and structure thereof, welding spots or areas 5 are provided in a central region of these end bags respectively.

At the intermediate area of tongue 1, in order to allow for a certain degree of aeration of the foot fitted inside the footwear, two rows of through perforations 6 are provided, whose outline follows the one of the longitudinal inflatable bags 2. The base of the tongue, which must be fastened to the shoe upper, extends into a flap 7 of the same gas-tight material comprising the walls of the inflatable bags 2.

B. The Pump

Figure 6:
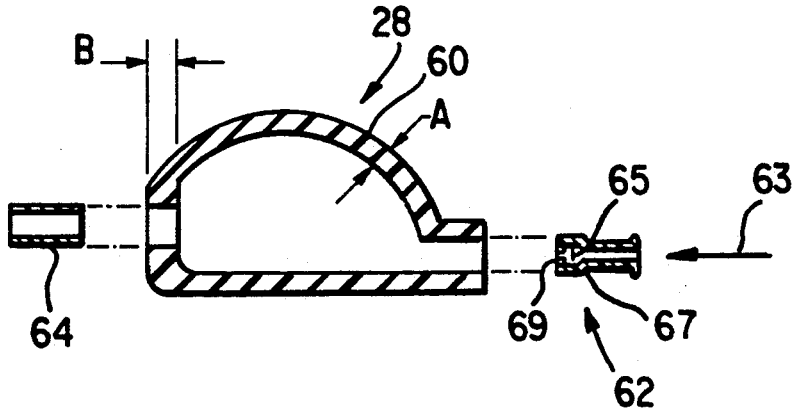
FIG. 6 is a cross section of the pump of FIG. 2 cut along line 6—6.

In the embodiment of the invention shown in FIGS. 2 and 4, the pump 28 has a body portion 60 which is made of a rubber material. The pump 28 may be molded from rubber such as butyl rubber or a latex rubber to form a rubber bulb. The pump 28 may also be a molded urethane or other material having good memory characteristics. If the pump 28 is a molded urethane, it can be welded to the bladder 30 with r.f. welding or the like. This embodiment of the invention simplifies construction of the pump and bladder assembly. The body is substantially hemispherical in shape with the flat portion of the hemisphere adhered to the exterior layer 32. At one end of the body portion 60 of pump 28 is a first pump valve 62 which prevents air from passing from the pump 28 to the atmosphere while allowing air to pass into the body portion 60. At the other end of body portion 60 is a connector 64 which enables fluid (typically air) to be communicated from the pump 28 to the interior of the bladder 30 which is formed between the exterior layer 32 and the interior layer 34. At the end of the connection between the pump 28 and the bladder 30 is a second one-way valve 66 which enables air to be forced into the bladder upon application of pressure to the pump 20. The one-way valve 66 prevents air from traveling from the bladder to the pump. Therefore, the bladder is pumped up simply by depressing the pump repeatedly until the bladder has reached a desired pressure. An exploded cross section of the pump of FIG. 2 is shown in FIG. 6. The pump 28 has a flat lower surface which is adhered to the bladder 30 and a hemispherical upper surface which enables air to be pumped into the bladder upon depression. The pump 28 may be made of injection molded rubber and may include an inlet check valve or first pump check valve 62 which is fitted into an opening in the pump 28.

FIG. 6 depicts the check valve 62 positioned outside the opening. In actual use, the check valve 62 is inserted into the hole and only enables air to travel in the direction of arrow 63. The operation of the check valve is as follows. A disc 65 for check valve is fitted between a shoulder 67 and retaining pins 69. The sic is free to move within the check valve 62 because it has a smaller diameter than the interior cylinder formed by check valve 62. If air is moving in the direction opposite the arrow 63, the disc abuts the shoulder an air cannot escape through the check valve. If, however, air is entering the check valve 62 in the direction of arrow 63, the disc 65 is retained against the retaining pins 69. The pins are intermittently spaced around the periphery of the cylindrical space forming the valve, thereby enabling air to pass around the disc 65 in those areas where the pins are not located. In short, the one-way check valve 62 enables air to move therethrough in the direction of arrow 63 only. During operation of the pump, the body of the pump 28 is squeezed, forcing air through a connector 64 an ultimately into the bladder. In actual use, the connector 64 would be inserted in a hole in one side of pump 28. The air which previously occupied the pump body portion is forced through the connector 64, through a one-way check valve (not shown in FIG. 6), and then into the bladder. That is, it will tend to return to its original shape after being squeezed. As the pump body returns to its ordinal shape, air is forced through the check valve 62 in the direction of arrow 63. The pump is repeatedly squeezed to provide the desired pressure of air to the bladder. In a preferred embodiment of the invention, the wall thickness dimension A in FIG. 6 is approximately 2.0 mm and the wall thickness dimension B is approximately 3.0 mm.

In another embodiment of the invention (shown in FIG. 23), a small hole is formed on the top of the pump body 60. This hold obviates the need for one way check valve 62. By using a small hole in the top of the pump body 60, air is not permitted to escape to the atmosphere when the pump 28 is depressed because the thumb or finger of the user covers the hole. As the pump is released by the user, the small hole is uncovered, allowing air to enter the pump body 60. This embodiment facilitates easy and inexpensive manufacture of the pump and bladder system.

Figure 8:
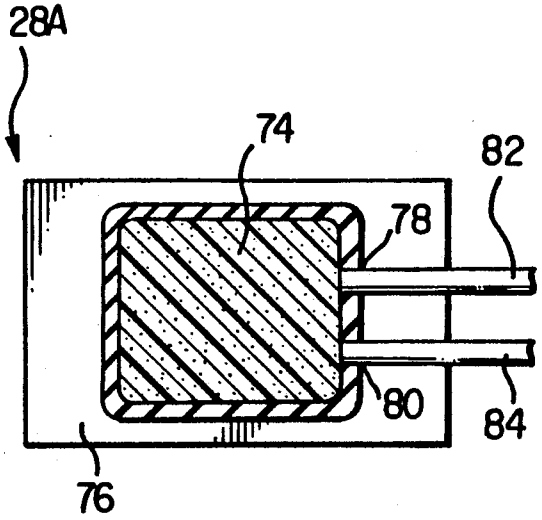
FIG. 8 is a top view of an embodiment of a pump of the present invention.
Figure 7:
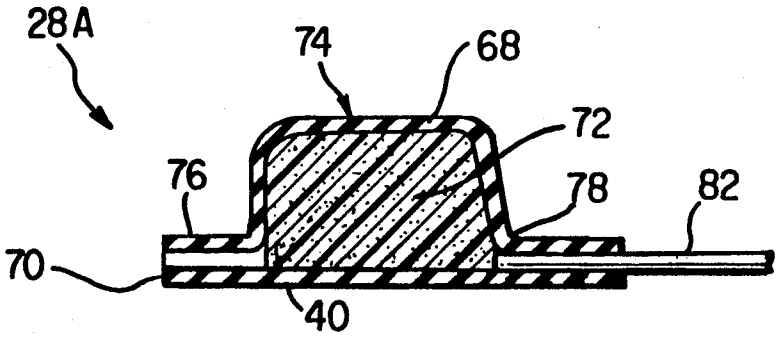
FIG. 7 is a cross section of one embodiment of the pump utilized in the invention.

With particular reference to FIGS. 7 and 8, another embodiment of a pump 28A for inflating bladder 30 is shown. Pump 28A includes a top layer 68 and a bottom layer 70, both of which are made from any suitable material, for example, a urethane film. One example of a urethane film which is applicable in the present invention is available from J. P. Stevens & Co., Inc., Northampton, Mass., as product designation MP1880. Disposed between top layer 68 and bottom layer 70 may be foam member 72. The function of foam member 72 is to add resiliency to pump 28A. Foam member 72 may be made of any suitable porous material which is capable of allowing fluid to pass therethrough. One example of a suitable material is in polyurethane open-cell foam having 10 to 55 PPI (pores per inch). Such as material is available from United Foam Plastics of Georgetown, Mass. Naturally, pumps other than the molded pump and the pump having a foam member in its interior could be substituted for those pumps specifically described in the present invention.

The bottom layer 70 of the pump 28 may be a substantially flat sheet of material which forms the side of the pump 28 which lies adjacent to the upper 14 as seen in FIG. 1. Top layer 68 is a vacuum formed sheet which is shaped to define a cavity, and foam member 72 is commensurate in size to the cavity and is disposed therein.

The top layer 68 forms a first surface 74 which provides a surface convenient for forcing air from the cavity into bladder 30. The top layer 68 also has edge 76 which provides a surface for suitable attachment to the bottom layer 70. One example of a suitable method of attachment is by the application of high radio frequency (r.f.) to edge 76 and the bottom layer 70. Application of the r.f. will cause the top and bottom layers 68 and 70, respectively, to adhere to one another. However, attachment methods other than r.f. welding are possible.

Referring specifically to FIGS. 7 and 8, one possible pump 30 is shown in which the cavity formed by top layer 68 and bottom layer 70 is approximately 1.0"×1.0"×0.5". The precise size and shape of the pump may be varied. Provided on pump 30 is an inlet port 78 and an outlet port 80. These ports may extend between the top layer 68 and the bottom layer 70 as shown or may extend through either the top layer 68 or bottom layer 70.

The pump 30 will generally be disposed on the upper 14 of athletic shoe 10. In FIG. 1, pump 30 is shown to be located in the back of the shoe with the bottom layer 70 being adjacent or next to the material forming the upper. The pump may also be located in other locations such as on the tongue of the shoe or on the vamp of the shoe. In the embodiment of the bladder depicted in FIG. 3, the pump is located in the tongue 22 of an athletic shoe. In this embodiment, the bladder can lie between the leather or other flexible material which forms upper 14 and a soft material which forms the interior of the shoe. If desired, the pump 30 can fit within a hemispherical cavity formed in the leather upper. This cavity can be formed from any of a number of conventional materials.

In the embodiment of the invention shown in FIGS. 7 and 8, the pump 30 is in fluid communication with the atmosphere via inlet tube 82. The outlet tube 84 is in fluid communication with the bladder 36. This can be seen in the schematic representation of the system which is depicted in FIG. 9.

The tubing which may be utilized with the present invention may be comprised of any suitable flexible, small diameter tubing material which is capable of being affixed to pump 28 and bladder 30. One example of tubing which is suitable for use with the present invention is a 1/16 inch I.D×⅛ inch clear polyurethane tubing which is available from Industrial Specialties, Inc., Englewood, Colo.

The inlet tube 82 has thereon an inlet check valve 86 which assures that air only flows into pump 28 from the atmosphere. One example of acceptable check valves for use with the present invention is model #2804-401, available from Air Logic, Racine, Wis., (other outlet valves will be discussed in detail below). The outlet tube 84 has an exit check valve 88 which ensures that, after bladder 30 is inflated to a desired pressure, air does not flow out of the bladder 30 through pump 28.

Figure 9:
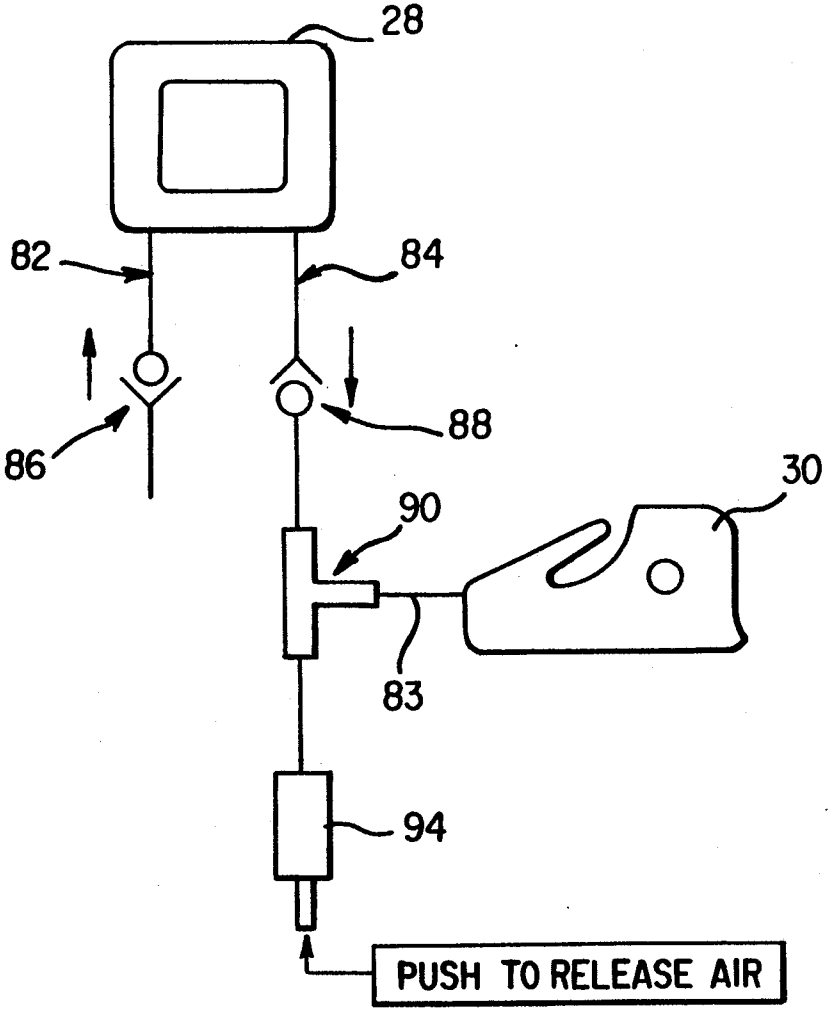
FIG. 9 is a schematic of one embodiment of the pump system used in the present invention.

As seen with continuing reference to FIG. 9, the outlet tube 84 is connected to a T-connector 90. Naturally, the exact shape of the T-connector 90 need not be a T-shape. The T-connector 90 enables air passing through outlet tube 84 to be in fluid communication with the bladder through a bladder inlet 83.

In operation, the pump 28 is depressed, thereby compressing foam member 72 if a pump having a foam member is used. The air which previously occupied the cavity in the pump 30 is prevented by a check valve 86 from escaping to the atmosphere. Therefore, the air is forced through outlet tube 84, through check valve 88 and into bladder 30. After the pump 30 is manually depressed, it is released. The foam and the other materials used to form the pump are made of materials with good memory and therefore the pump 30 quickly returns to its pre-depressed state. As it returns to its original shape, ambient air is sucked through inlet tube 82 (if used) via the one-way inlet check valve 86, into the cavity of pump 30. The pump is then depressed again and the process is repeated until the bladder 30 is inflated to a desired pressure.

To release pressure, release valve 94 may be depressed to allow air to escape from bladder 30. This release valve 94 may be positioned in a number of different locations as long as it is in fluid communication with the bladder 30. The details of a preferred release valve will be set forth below.

C. Release Valve

As previously mentioned, a release valve is used as part of the invention to vent air from the bladder. The release valve 94 is in fluid communication with the bladder 30 to enable venting or deflating of the bladder 30. While the release valve 94 may be located anywhere on the bladder 30, it is preferable that the release valve 94 be located on the bladder 30 where it can be conveniently activated by the user of the athletic shoe. For example, it may be preferable to place the release valve 30 close to the location of the pump 28.

Figure 10:
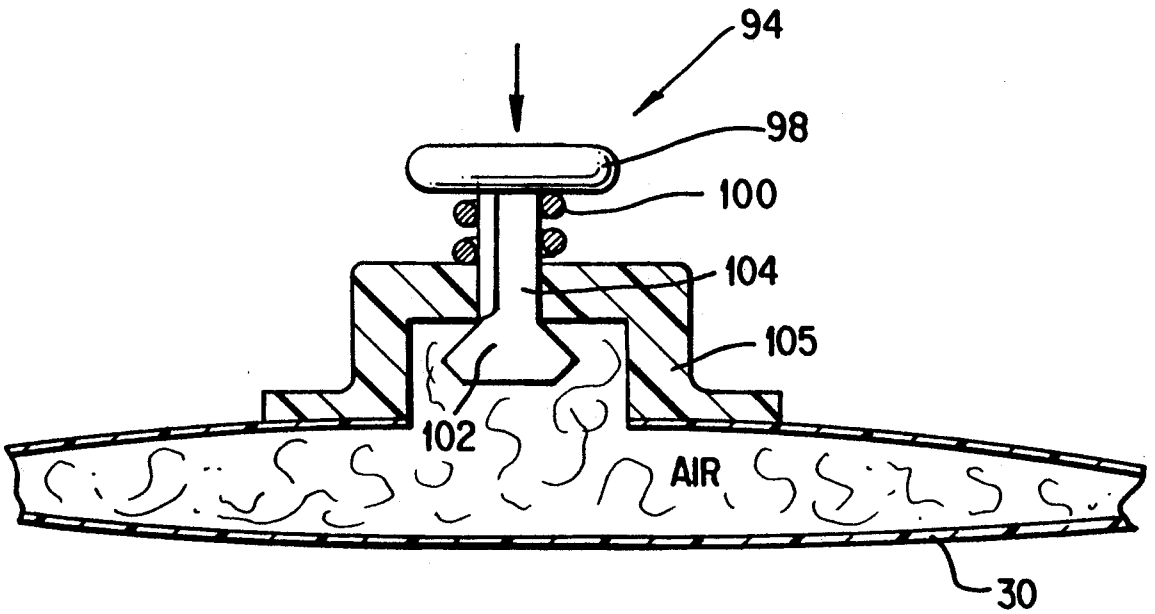
FIG. 10 is a cross sectional view of one valve used in the present invention.

While there may be a number of different types of release valves 30 which are suitable for practicing the invention, one preferred release valve is the simple device as shown in FIG. 10. The release valve 94 as shown in FIG. 10 can include a plunger 98 having a spring 100 which biases the plunger in the closed position as shown in FIG. 10. A flange 102 around the periphery of stem 104 of the plunger 98 keeps air from escaping between the plunger 98 and the release fitting 105 because the flange is biased in the closed position and in contact with the release fitting 105. To release air from the bladder 30, the plunger 98 is depressed by the user. Air then escapes around the stem 104 of plunger 98. This release valve is mechanically simple and light weight.

The components of the release valve may be made out of a number of different materials including plastic or metals. It may be preferable to use a material such as aluminum to form the plunger 98 because it is easier to ensure that an aluminum plunger will be of a particular geometry (e.g., round), thus avoiding leakage problems which can be created by a plunger of irregular shape.

In a preferred embodiment of the invention, the release fitting 105 is made of a molded urethane and, in fact, the release fitting 105 and the pump 28 may both be molded as a unitary single piece. Thus, a single molded urethane piece which comprises a pump 28 and a release fitting 105 can be welded to the urethane sheets which form a bladder 30.

Figure 23:
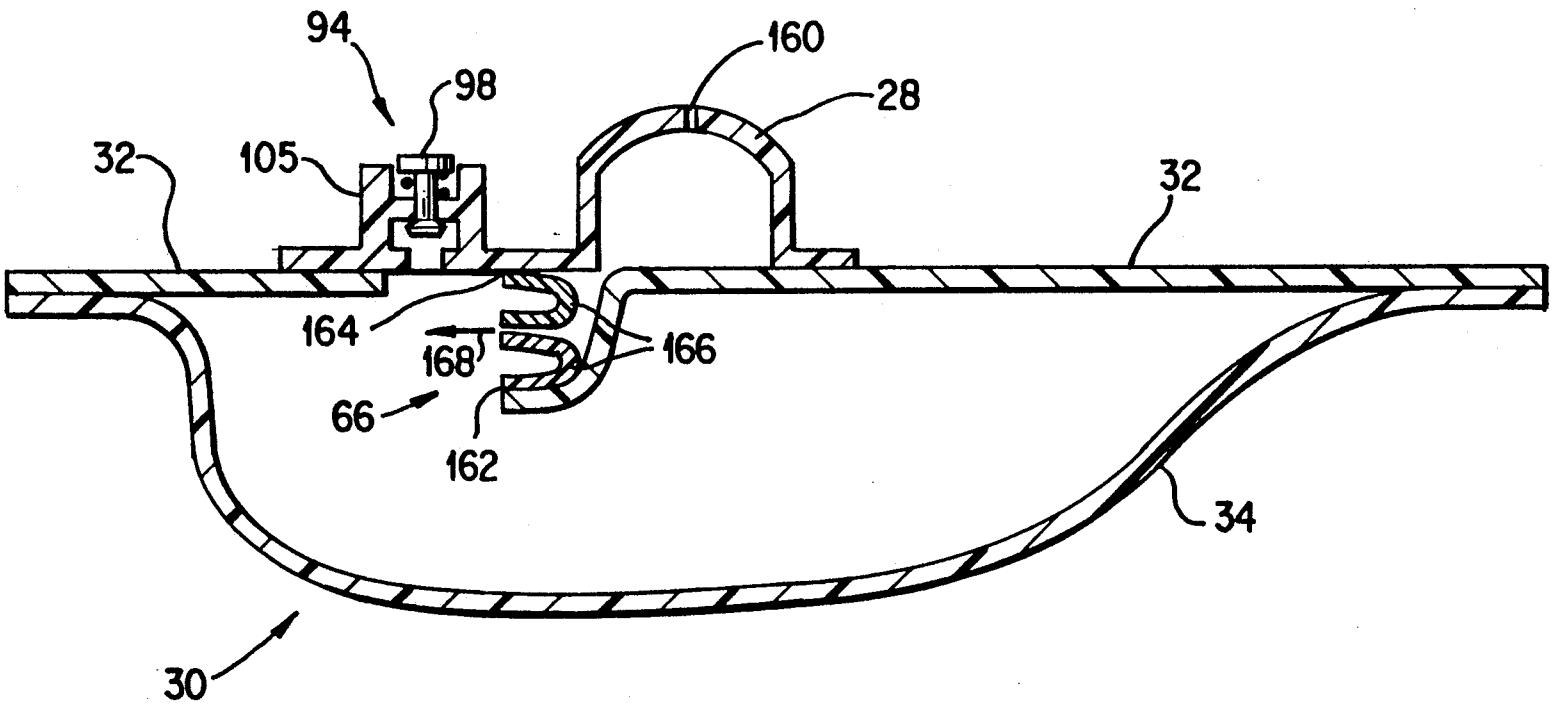
FIG. 23 is a cross sectional view of the bladder, pump and release valve of the present invention.

FIG. 23 is a schematic cross section of a pump release valve and bladder assembly in which the pump and release fitting are molded as a unitary structure. This figure is intended for purposes of illustration and example and is not intended to be a scale representation. FIG. 23 depicts an exterior layer 32 and an interior layer 34 which are welded together to from bladder 30. A pump 28 is provided which is made of molded urethane. A release valve 94 is also provided which, like the release valve depicted in FIG. 10, has a plunger 98 and a spring around the stem of the plunger. The release valve 94 has a release fitting 105 which is molded urethane. In a preferred embodiment of the invention, the pump 28 and the release fitting 105 are formed from a single piece of material. The pump 28 and release fitting 105 assembly is then welded to the bladder 30.

In the embodiment of the invention shown in FIG. 23, a small hole 60 is provided in the top of the molded pump 28 to allow air to pass into the pump and to act as a one way valve.

In operation, the pump 28 is depressed. The user typically will use a thumb to depress the pump 28; therefore, hole 160 is covered and air is free to pass into the bladder 30. After the pump is released by the thumb of the user, air passes through hole 160 to fill the pump interior volume.

Provided between the pump 23 and the bladder 30 30 may be a second one way valve 66. This valve may be of the type described earlier with reference to FIG. 6 or may be as described below. The second one way valve 66 shown in FIG. 23 utilizes a pair of sheets of urethane material 166 which may be welded at weld points 162, 164. The sheets are folded in substantially a U-shape and allow air to pass therethrough only in the direction of arrow 168. Thus, a simple one way valve is constructed which is inexpensive and simple to manufacture.

To release the air from bladder 30, the plunger 98 of release valve 94 is depressed, enabling air to pass from the bladder 30 around the plunger 98 and into the atmosphere.

D. Dual Chamber Bladder Embodiment

Figure 11:
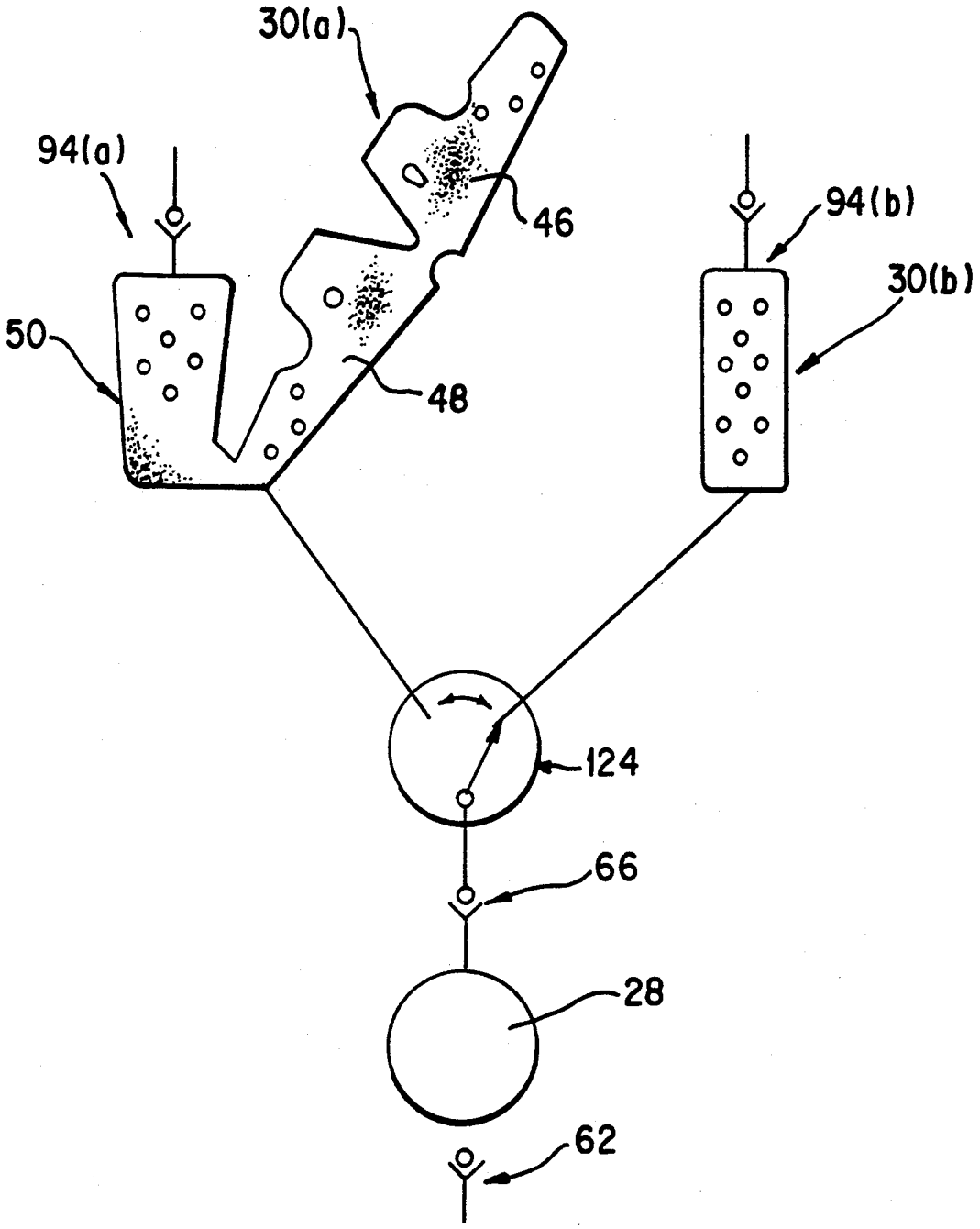
FIG. 11 is a schematic of a dual chamber bladder of the present invention.
Figure 12:
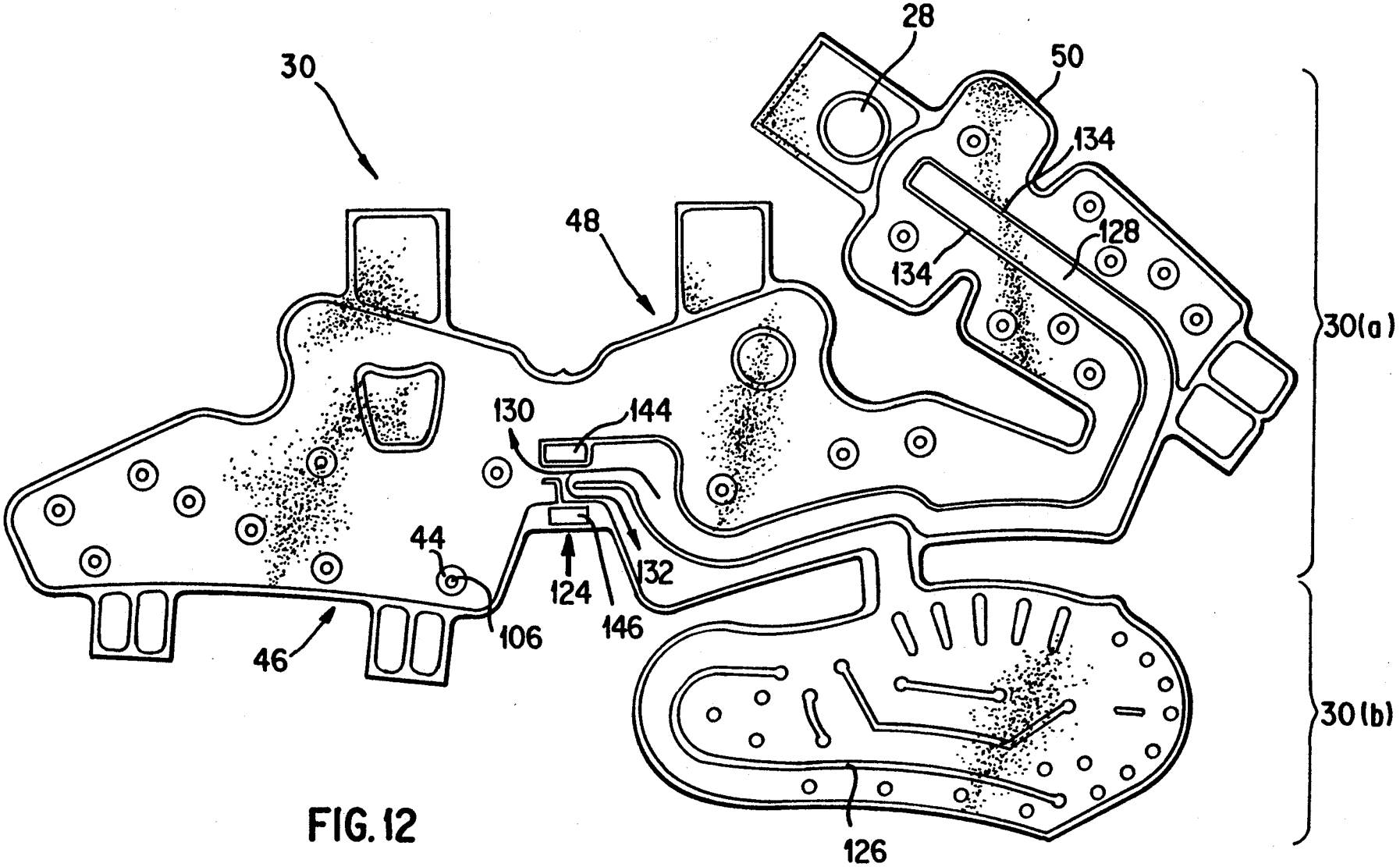
FIG. 12 is a dual chamber bladder of the present invention.
Figure 13:
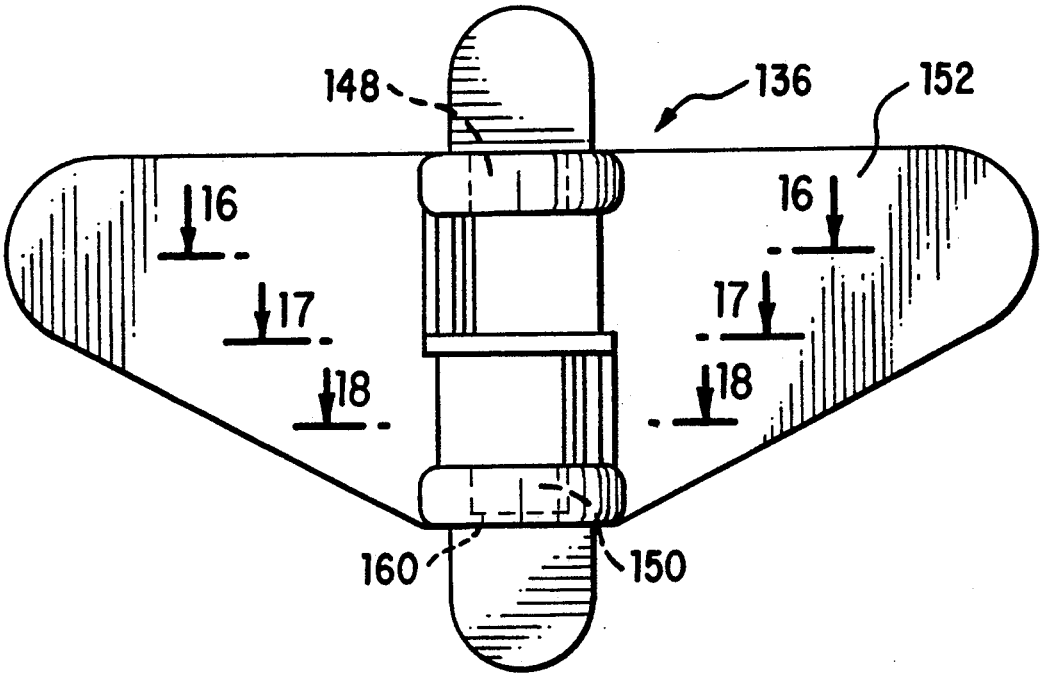
FIG. 13 is a backer plate of the present invention.
Figure 14:
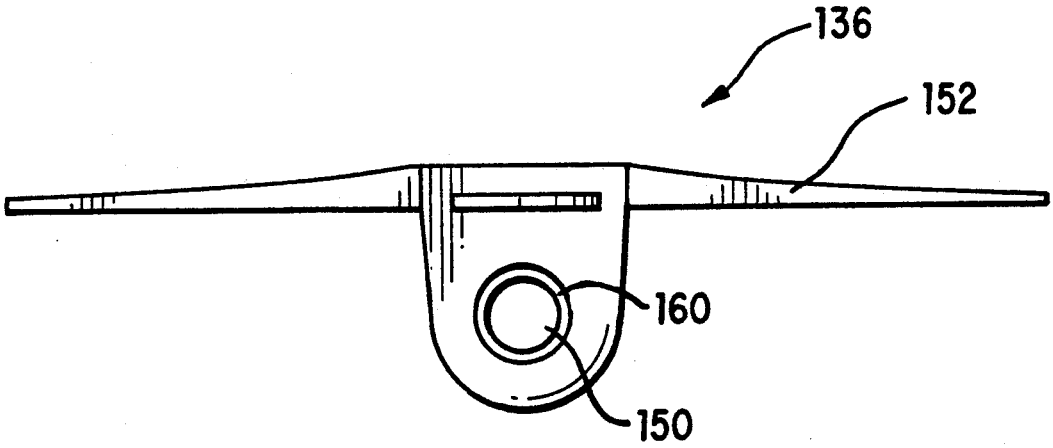
FIG. 14 is a top view of the backer plate of FIG. 13.
Figure 15:
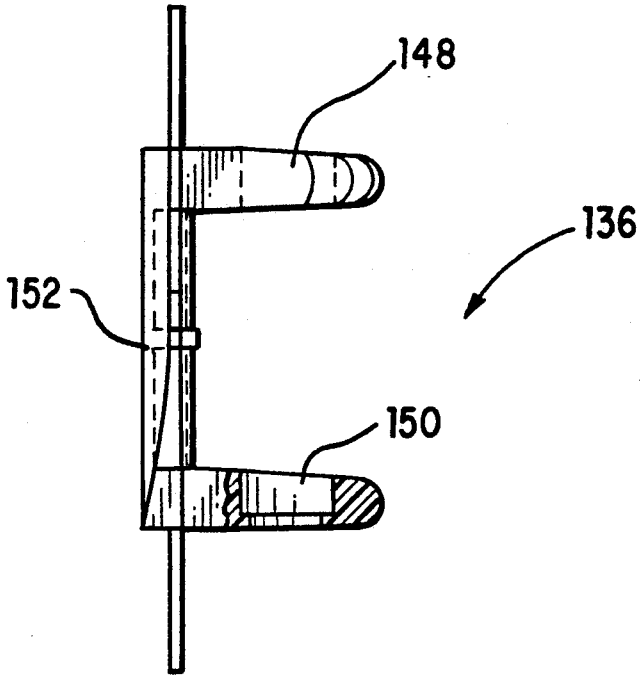
FIG. 15 is a side view of the backer place of FIG. 13.
Figure 16:
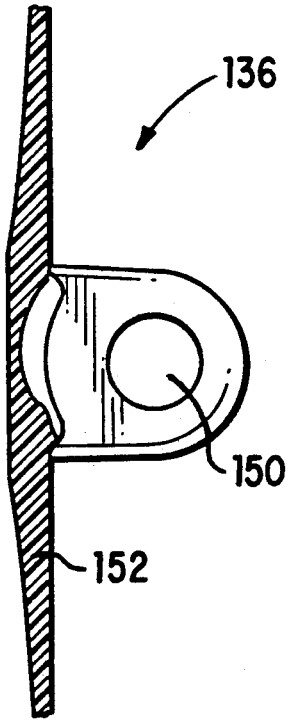
FIG. 16 is a cross section view of FIG. 13 cut along line 16—16.
Figure 17:
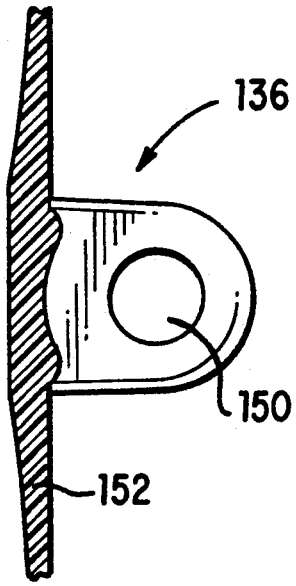
FIG. 17 is a cross section view of FIG. 13 cut along line 17—17.
Figure 18:
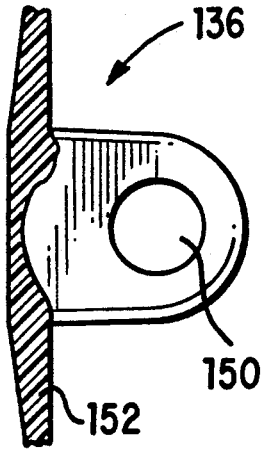
FIG. 18 is a cross section view of FIG. 13 cut along line 18—18.
Figure 19:
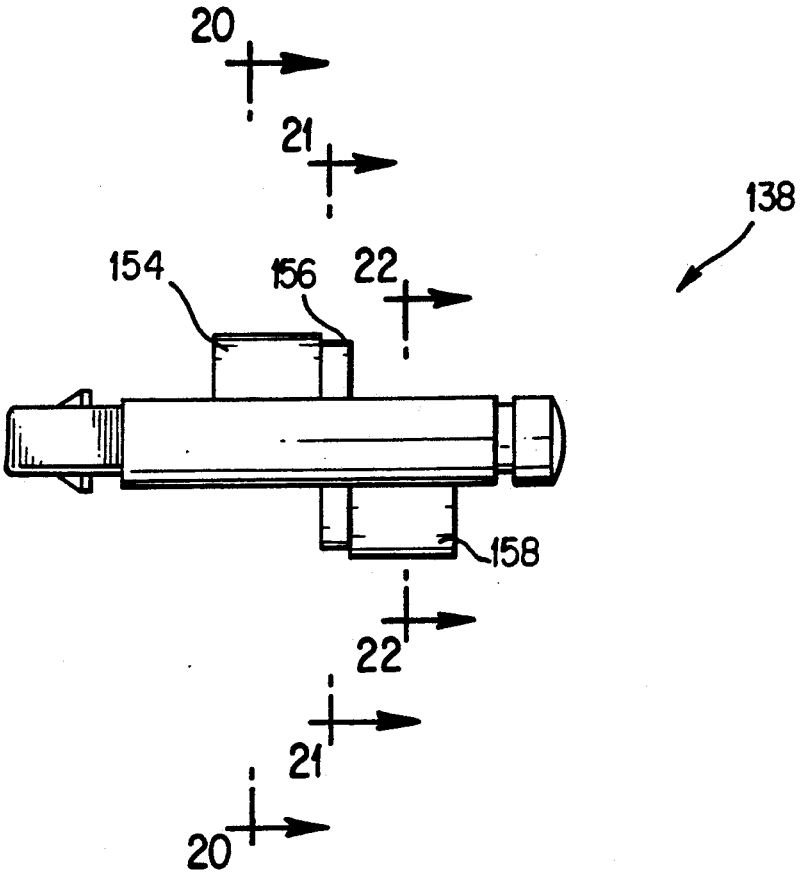
FIG. 19 is a cam device of the present invention.
Figure 20:
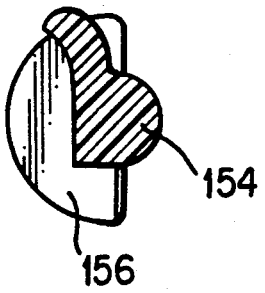
FIG. 20 is a cross section view of FIG. 19 cut along line 20—20.
Figure 21:
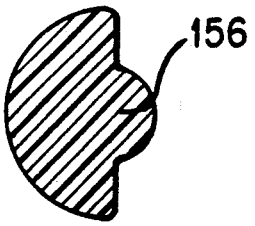
FIG. 21 is a cross section view of FIG. 19 cut along line 21—21.
Figure 22:
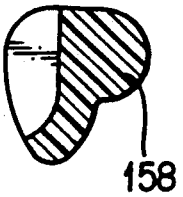
FIG. 22 is a cross section view of FIG. 19 cut along line 22—22.

In one embodiment of the invention, depicted in FIGS. 11 and 12, a dual chamber bladder system is used to selectively inflate predetermined regions of an athletic shoe. In this embodiment, a plurality of bladder chambers 30(*a*) and 30(*b*) are used in the invention. In the embodiment of the invention shown in FIG. 12, bladder chambers 30(*a*) and 30(*b*) are formed from the same material and are stamped out from the same sheets of urethane film. One of the bladder chambers may be positioned in the upper of the shoe as described with respect to the bladder depicted in FIG. 3. The bladder chamber 30(*a*) shown in FIG. 12 may take on a number of different shapes. However, like the bladder of FIG. 3, it may have a tongue compartment 50, a medial compartment 48 and a lateral compartment 46. As previously described, the bladder 30 may use circular welds formed by r.f. welding in selective areas of the bladder. The circular welds 44 may have aeration holes 160 therethrough as also previously described.

Similarly, a second bladder chamber 30(*b*) is provided which may be constructed in a manner similar to bladder chamber 30(*a*). That is, the bladder chamber 30(*b*) may be constructed using two thin sheets of urethane film which are welded together by r.f. welding or other suitable means and die-cut in a desired shape. The second bladder chamber 30(*b*) may be cut in a suitable shape to be inserted under the foot of a wearer to provide additional cushioning to the underside of the foot. Like bladder chamber 30(*a*). bladder chamber 30(*b*) may have suitable weld configurations which may include weld lines 126 as well as circular welds 44 as needed to accommodate the lower surface of a foot.

In a preferred embodiment of the invention, a single pump 28 is used to selectively inflate the two bladder chambers. Disposed downstream of pump 28 and upstream of the bladder chambers 30(*a*) and 30(*b*) is a manual switch 124 which enables a user to inflate either the bladder chamber 30(*a*) which is disposed in the upper or bladder chamber 30(*b*) disposed under the foot of the wearer. The switch 124 is not depicted in FIG. 12; however, the location of the switch used in the bladder of FIG. 12 is indicated by arrow 124. It may also be possible to utilize a three-way switch to selectively pump either bladder chamber 30(*a*), bladder chamber 30(*b*), or both bladder chambers 30(*a*) and 30(*b*) simultaneously. Each bladder chamber 30(*a*), 30(*b*) is provided with a release valve 94(*a*) and 94(*b*) which enables excess air to be released from the bladder chambers 30(*a*), 30(*b*). One-way valve 62 as described with reference to FIG. 6 may be provided to allow air to fill the pump 28 after it has been depressed.

A second one-way valve 66 is also provided which keeps air which is forced out of pump 28 from returning to the pump 28 after the pump 28 is depressed.

Turning specifically to FIG. 12, a preferred embodiment of the dual chamber bladder is depicted. In operation, the pump 28 is manually operated to introduce air into channel 128 via a suitable conduit (not shown). The conduit and the pump 28 can be molded from a single piece of material. Channel 128 is in fluid communication with both bladder chamber 30(*a*) and bladder chamber 30(*b*) as shown by flow streams 130 and 132, respectively. Channel 128 is bounded by channel weld lines 134 which prevent air from entering bladder chamber 30(*a*) except as indicated by flow stream 130.

As can be seen in FIG. 12, the location of the valve for switching between bladder chamber 30(*a*) and bladder chamber 30(*b*) is the back of the heel of a wearer. This location is chosen for convenience of the user; however, it is understood that there are other suitable locations.

As previously stated, either bladder chamber 30(*a*) or 30(*b*) is selectively inflated by use of a valve which enables air to be directed to one or the other of the bladder chambers 30(*a*) or 30(*b*).

In a preferred embodiment of the invention, a switch is used which pinches off either flow stream 130 or flow stream 132 according to the preference of the user.

Although a number of different switches can be used to select which bladder chamber is to be inflated, one preferred pinching switch is shown in FIGS. 13–22. The pincher switch is constructed with two main components, a backer plate 136 (seen in FIGS. 13–18) and a cam device 138 (seen in FIGS. 19–22).

The bladder 30, seen in FIG. 12, is sandwiched between the backer plate 136 made of material such as transparent polyurethane and cam device 138 made of a hard plastic material such as acro butyl styrene (ABS) to selectively pinch off either flow stream 130 or flow stream 132.

The backer plate 136 includes projections 140 and 142 which project through openings 144 and 146 (seen in FIG. 12). The projections 140 and 142 form circular openings 148 and 150 for receiving cam device 138. The bladder 30 is thus oriented between cam device 138 and surface 152 on backer plate 136. The cam device 138 has a plurality of cam surfaces 154, 156 and 158 which cooperate with surface 152 of backer plate 136 to pinch off either flow stream 130 or flow stream 132. The cam device 138 is rotatably positioned in the circular openings 148 and 150. As the cam device 138 si rotated from a first position to a second position, the cam surfaces serve to pinch off either flow stream 130 or flow steam 132. A lip 160 is provided on the backer plate 136 (see FIG. 14) to prevent the cam device 138 from sliding completely through the circular openings 148, 150.

Figure 25:
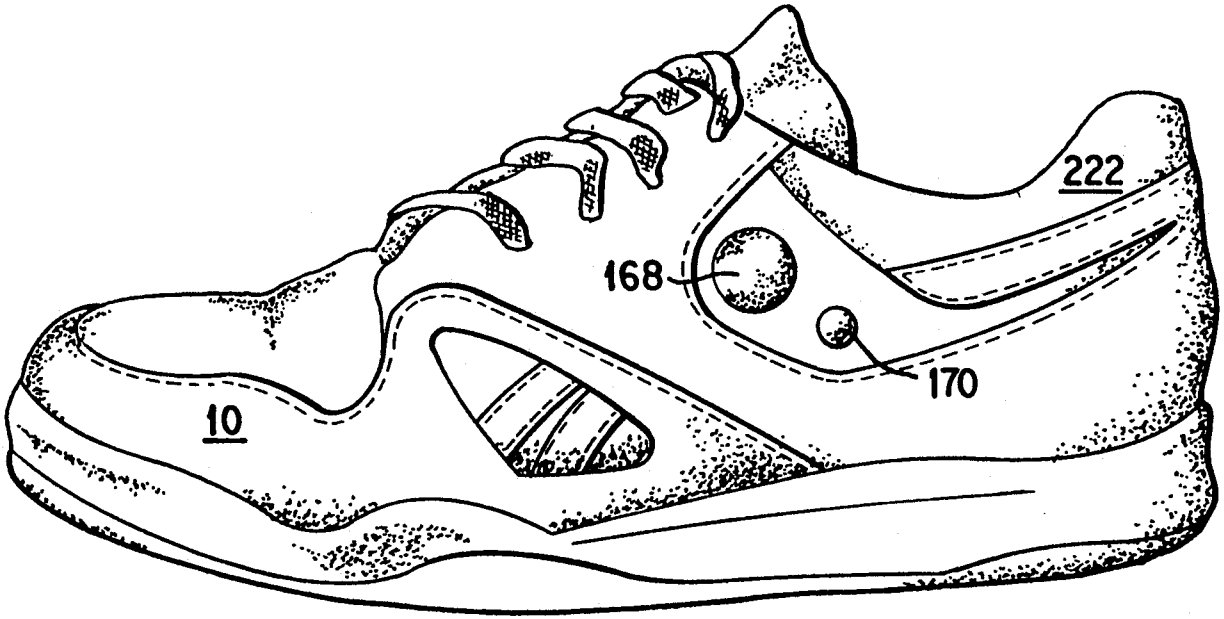
FIG. 25 is a lateral side view of a shoe incorporating the present invention.

Although the dual chamber bladder system described above locates the bladder chambers 30(*a*), 30(*b*) on the upper and under the wearer's foot, respectively, it is possible to have dual bladder chambers in other configurations. For example, a first bladder chamber could be located around the collar of a shoe (such as a basketball or tennis shoe) while a second bladder chamber could be located at the instep (the collar of the shoe depicted in FIG. 25 is designated with reference numeral 222). Similarly, more than two bladder chambers, with a selective inflation valve, could be utilized in practicing the invention.

E. Alternative Bladder Configurations

Figure 24:
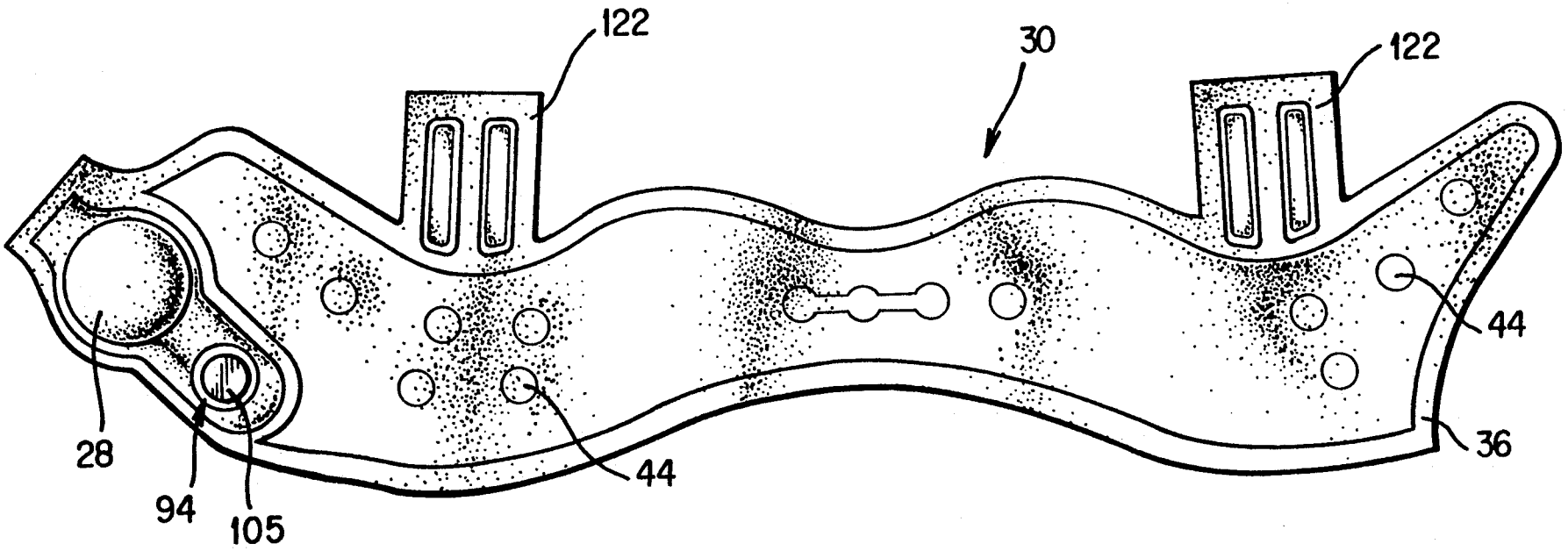
FIG. 24 is a collar bladder of the present invention.

Several other bladder configurations other than those described above may be used to practice the invention. For example, a bladder may be used which is specifically oriented in the collar of an athletic shoe. FIG 24 shows a collar bladder of the present invention. Bladder 30, like previous embodiments, utilizes two sheets of urethane film welded together at periphery weld lines 36 and at circular welds 44. A pump 28 is provided which is made of molded urethane. The pump 28 and release fitting 105 of release valve 94 are monolithic. A plunger 94 fits within release fitting 105. When placed in an athletic shoe, bladder 30 wraps around the back of the foot of the wearer such that centering tabs 122 are substantially in line on opposite sides of the wearer's foot.

FIG. 25 shows generally the location of the pump and release valve on an athletic shoe 10. The pump 30 (of FIG. 24) is covered by pump covering 168 and the release valve (of FIG. 24) is covered by release valve covering 170.

Figure 26:
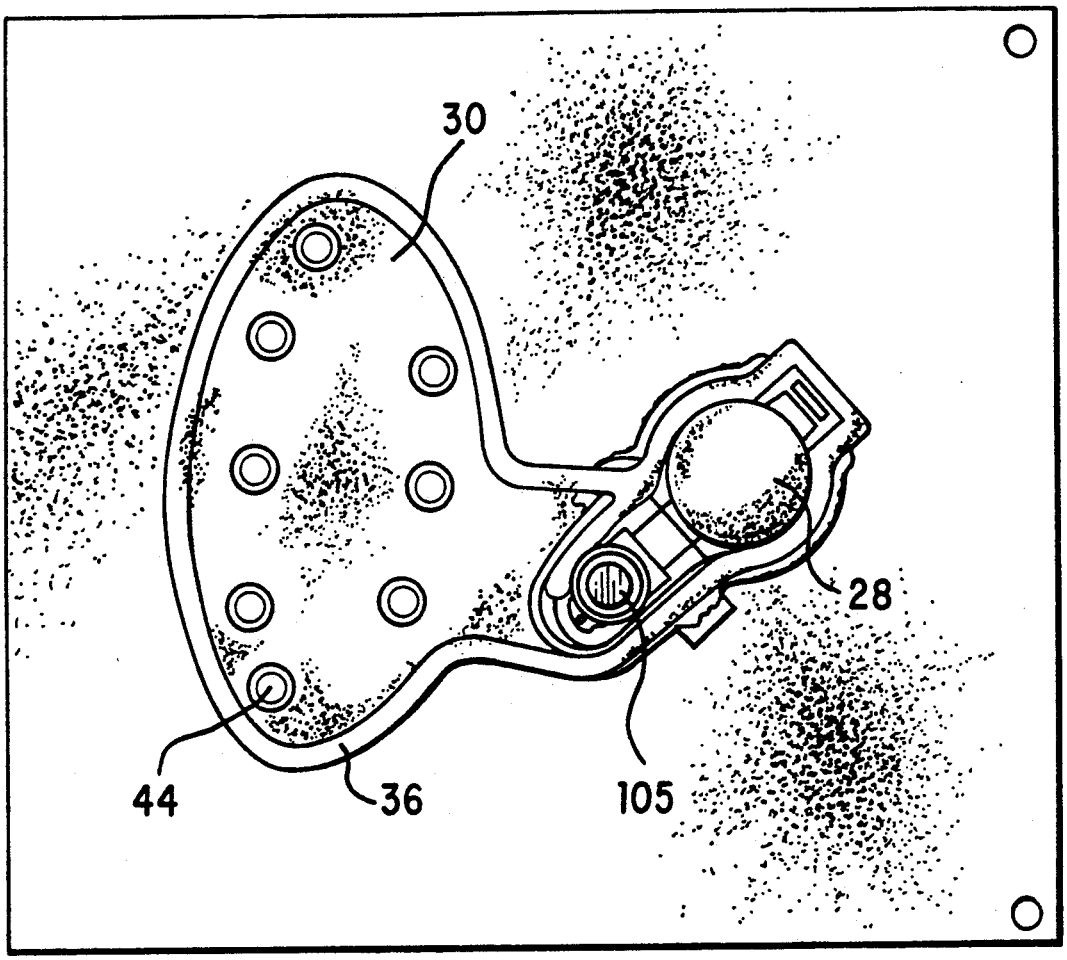
FIG. 26 is an arch bladder of the present invention.

In yet another embodiment of the invention depicted in FIG. 26, an arch bladder 30 is provided which like previously described bladders utilizes periphery weld lines 36 to attach two sheets of urethane. In FIG. 36, the arch bladder has been welded but is shown prior to die cutting the bladder along periphery weld lines 36. In operation, the bladder 30 of FIG. 26 fits under the arch of the foot and the pump 28 and release valve 94 wrap up the side of the shoe to be conveniently located on the side of the shoe (in a manner similar to FIG. 25).

The foregoing description of the preferred embodiments of the invention have been presented for purposes of illustration and description. It is not intended to be exhaustive or to limit it to the precise form disclosed. Obviously, many modifications and variations may be made in light of the above teachings.

The embodiments were chosen and described in order to best explain the principles of the invention and its practical application to thereby enable others skilled in the art to best utilize the invention in various embodiments and with various modifications as are suited to the particular use contemplated. For example a bladder may be designed which conforms to parts of the foot other than those parts specified above. In addition, in one embodiment of the invention, a pressure gauge, such as a digital read-out pressure gauge, can be incorporated into the shoe using the present invention to enable a user to consistently add the same air pressure to the bladder. Similarly, a second digital read-out pressure gauge can be used when more than one bladder is used. It is intended that the scope of the invention be defined by the claims appended hereto.

What we claim is:

1. An athletic shoe, comprising:

(a) a bladder, said bladder comprising a first sheet of flexible material and a second sheet of flexible material attached together to form said bladder therebetween wherein said bladder includes a first bladder chamber for providing cushioning to a wearer and a second bladder chamber for providing cushioning to the wearer, wherein said first bladder chamber and said second bladder chamber are both formed substantially by said first flexible sheet and said second flexible sheet;

(b) a pump for selectively introducing air to said first bladder chamber and said second bladder chamber;

(c) a channel disposed between said pump and said bladder, said channel providing a substantial portion of a conduit to at least one of said first and second bladder chambers and being formed by said first flexible sheet and said second flexible sheet such that said channel, said first bladder chamber and said second bladder chamber are all formed substantially from said first sheet of flexible material and said second sheet of flexible material; and (d) a valve disposed between said pump and said bladder for selectively preventing air from being introduced into one of said first and second bladder chambers wherein said valve includes a backer plate having a projection and a backer plate surface, said projection defining a circular opening, and a cam device rotatable disposed within the circular opening, wherein said bladder is disposed between said backer plate surface and said cam device, whereby said backer plate and said cam device pinch selective areas of said bladder to restrict the flow of air in said areas.

2. The athletic shoe of claim 1, wherein said first bladder chamber provides cushioning to the ankles of the wearer and said second bladder chamber provides cushioning under the foot of the wearer.

3. The athletic shoe of claim 2, wherein said second bladder chamber is located under the arch of the wearer.

4. The athletic shoe of claim 2, wherein said first bladder chamber comprises a medial compartment, a lateral compartment, and a tongue compartment.

5. The athletic shoe of claim 4, further comprising a release valve, wherein said release vale includes a release fitting which provides communication between said bladder and the ambient atmosphere and wherein said pump and said release fitting are molded from a single piece of material.

6. The athletic shoe of claim 5, wherein said material forming said pump and said release fitting is molded urethane.

7. The athletic shoe of claim 6, wherein said bladder comprises two sheets of urethane film which are welded together.

8. The athletic shoe of claim 7, wherein said molded urethane forming said pump and said release fitting is welded to said bladder.

9. The athletic shoe of claim 1, wherein said pump defines a hole which acts as a one way valve to enable air to be introduced into said pump.

10. A bladder system for providing cushioning and support, comprising (a) a first sheet of flexible material, said first sheet of flexible material being substantially fluid impervious;

(b) a second sheet of flexible material, said second sheet of flexible material being substantially fluid impervious;

(c) said first and second sheets of flexible material being attached together to form a first bladder chamber, a second bladder chamber and a channel wherein said channel has a first passageway allowing fluid communication between said channel and said first bladder chamber and a second passageway for allowing fluid communication between said channel and said second bladder chamber;

(d) a pump for introducing a fluid into said channel;

(e) a one-way valve disposed downstream of said pump for preventing fluid moved by said pump from flowing therethrough in the direction of said pump;

(f) a switch for selectively preventing fluid from flowing into one of said first and second bladder chambers, said switch comprising a backer plate disposed adjacent one of said sheets of flexible material and a cam device having a longitudinal axis, said cam device being disposed adjacent the other of said sheets of flexible material wherein upon rotating said cam device relative to said backer plate about said longitudinal axis, said cam device selective prevents fluid from passing into one of said first bladder chamber and said second bladder chamber by pinching off the flow of air into one of said chambers; and (g) a release valve for venting air from at least one of said first and second bladder chambers.

11. The bladder system of claim 10 wherein said release valve comprises a release fitting defining an opening and a plunger, wherein said plunger is disposed within said release fitting.

12. The bladder system of claim 11 wherein said plunger of said release valve comprises aluminum.

13. The bladder system of claim 12 wherein said plunger has a circular cross section.

14. The bladder system of claim 10 wherein said first bladder chamber is configured to fit in the upper of an athletic shoe, and said second bladder chamber is oriented to fit within the sole of an athletic shoe.

* * * * *

UNITED STATES PATENT AND TRADEMARK OFFICE
CERTIFICATE OF CORRECTION

PATENT NO. : 5,113,599

DATED : May 19, 1992

INVENTOR(S) : Cohen et al.

It is certified that error appears in the above-identified patent and that said Letters Patent is hereby corrected as shown below:

Column 1, line 6, delete "07/503,854," and substitute therefor --07/530,854--;
line 16, delete "hoses" and substitute therefor --shoes--.

Column 4, line 31, delete "shoes" and substitute therefor --shoe--.

Column 8, line 53, delete "4"" and substitute therefor --4'--.

Column 9, line 43, delete "sic" and substitute therefor --disc--;
line 58, delete "an" and substitute therefor --and--;
line 65, delete "ordinal" and substitute therefor --original--.

Column 10, line 29, delete "in" and substitute therefor --a--.

Column 11, line 19, after "1/8 inch" insert --O.D.--.

Column 12, line 39, delete "from" and substitute therefor --form--;
line 50, delete "60" and substitute therefor --160--;
line 59, delete "30" second occurrence.

Column 13, line 24, delete "160" and substitute therefor --106--.

Column 14, line 39, delete "si" and substitute therefor --is--.

Column 16, line 68, delete "selective" and substitute therefor --selectively--.

Signed and Sealed this

Nineteenth Day of October, 1993

*Attest:*

Bruce Lehman

BRUCE LEHMAN

*Attesting Officer*

*Commissioner of Patents and Trademarks*